US011958666B2

(12) United States Patent
Sibley et al.

(10) Patent No.: US 11,958,666 B2
(45) Date of Patent: Apr. 16, 2024

(54) CHILD RESISTANT DOUBLE SEAM CONTAINER LID

(71) Applicant: N2 Packaging Systems, LLC, Twin Falls, ID (US)

(72) Inventors: David P. Sibley, Kimberly, ID (US); Randy S. Martin, Kimberly, ID (US); Michael G. Standlee, Eden, ID (US)

(73) Assignee: N2 PACKAGING SYSTEMS, LLC, Twin Falls, ID (US)

( * ) Notice: Subject to any disclaimer, the term of this patent is extended or adjusted under 35 U.S.C. 154(b) by 219 days.

(21) Appl. No.: 17/137,543

(22) Filed: Dec. 30, 2020

(65) Prior Publication Data

US 2021/0114783 A1 Apr. 22, 2021

Related U.S. Application Data

(63) Continuation-in-part of application No. 15/616,483, filed on Jun. 7, 2017, now abandoned.

(51) Int. Cl.
*B65D 50/04* (2006.01)
*B65D 21/02* (2006.01)
(Continued)

(52) U.S. Cl.
CPC ..... *B65D 50/046* (2013.01); *B65D 21/0217* (2013.01); *B65D 21/0219* (2013.01);
(Continued)

(58) Field of Classification Search
CPC ..... B65D 50/046; B65D 21/0217; B65D 21/0219; B65D 53/02; B65D 2543/00972
(Continued)

(56) References Cited

U.S. PATENT DOCUMENTS 1,381,831 A 6/1921 Heeren
2,857,083 A 10/1958 Masterson
(Continued)

FOREIGN PATENT DOCUMENTS

WO WO2014128428 8/2014

OTHER PUBLICATIONS

Ex Parte Quayle Action mailed Oct. 1, 2019 in U.S. Appl. No. 29/659,000, 7 pages.
(Continued)

*Primary Examiner* — James N Smalley
(74) *Attorney, Agent, or Firm* — Perkins Coie LLP

(57) ABSTRACT

The present invention is directed to a child resistant double seam container lid including an adapter ring for securely affixing to the double seam top rim of conventional double seamed containers that will be difficult for children to open, yet readily openable by adults. More particularly, a one-piece, two-piece, and three-piece child resistant double seam affixable container lid is provided having a first piece lid portion first, a second piece adapter ring locking member second piece and optionally a third piece securing unit piece, with rotational alignment indicators, and optional additional integral features such as a liquid measuring cup feature, a liquid tight lid feature, a threaded lid portion, a replaceable double seam container lid portion and a double seam container lid locking member adapter ring securely affixable to the double seam container.

11 Claims, 24 Drawing Sheets

(51) Int. Cl.

| | |
|---|---|
| ***B65D 41/26*** | (2006.01) |
| ***B65D 43/02*** | (2006.01) |
| ***B65D 45/30*** | (2006.01) |
| ***B65D 50/06*** | (2006.01) |
| ***B65D 51/20*** | (2006.01) |
| ***B65D 51/24*** | (2006.01) |
| ***B65D 53/02*** | (2006.01) |
| ***B65D 81/20*** | (2006.01) |

(52) U.S. Cl.
CPC ..... *B65D 41/26* (2013.01); *B65D 43/0212* (2013.01); *B65D 45/30* (2013.01); *B65D 45/305* (2013.01); *B65D 50/061* (2013.01); *B65D 50/067* (2013.01); *B65D 51/20* (2013.01); *B65D 51/242* (2013.01); *B65D 51/245* (2013.01); *B65D 53/02* (2013.01); *B65D 81/2015* (2013.01); *B65D 2205/02* (2013.01); *B65D 2543/00046* (2013.01); *B65D 2543/00092* (2013.01); *B65D 2543/0024* (2013.01); *B65D 2543/00435* (2013.01); *B65D 2543/00537* (2013.01); *B65D 2543/00638* (2013.01); *B65D 2543/00685* (2013.01); *B65D 2543/00731* (2013.01); *B65D 2543/00796* (2013.01); *B65D 2543/00925* (2013.01); *B65D 2543/00972* (2013.01)

(58) Field of Classification Search
USPC ..... 215/216, 305; 220/380; 206/508
See application file for complete search history.

(56) References Cited

U.S. PATENT DOCUMENTS

| | | | | | |
|---|---|---|---|---|---|
| 2,859,786 | A | | 11/1958 | Tupper | |
| 3,173,574 | A | * | 3/1965 | Goldsmith | B65D 21/022 206/508 |
| 3,281,008 | A | | 10/1966 | D'Andrea | |
| 3,419,181 | A | | 12/1968 | Stec | |
| 3,565,295 | A | * | 2/1971 | Doyle | B65D 83/40 220/915 |
| 3,642,161 | A | * | 2/1972 | Stroud | B65D 50/06 215/216 |
| 3,703,975 | A | * | 11/1972 | Wittemer | G11C 11/40 220/212.5 |
| 3,811,589 | A | | 5/1974 | Thornton | |
| 3,831,820 | A | | 8/1974 | Focht | |
| 3,964,634 | A | * | 6/1976 | Jasinski | B65D 83/40 222/153.1 |
| 4,119,239 | A | | 10/1978 | Anderson | |
| 4,129,687 | A | | 12/1978 | Lahme | |
| RE30,531 | E | | 3/1981 | Spector | |
| 4,279,353 | A | | 7/1981 | Honma | |
| 4,359,166 | A | | 11/1982 | Dubach | |
| 4,429,800 | A | | 2/1984 | Greenspan | |
| 4,480,762 | A | * | 11/1984 | Thomas | B65D 50/045 215/280 |
| 4,625,890 | A | | 12/1986 | Galer | |
| D292,324 | S | | 10/1987 | Decker | |
| 4,790,444 | A | | 12/1988 | Terzi | |
| 4,807,768 | A | | 2/1989 | Gach | |
| 4,809,874 | A | | 3/1989 | Pehr | |
| 4,852,757 | A | | 8/1989 | Gold | |
| 4,883,198 | A | | 11/1989 | Manska | |
| D309,109 | S | | 7/1990 | Allen | |
| 4,960,206 | A | | 10/1990 | Johannes | |
| 5,011,009 | A | | 4/1991 | Scheurer | |
| 5,040,691 | A | | 8/1991 | Hayes | |
| 5,050,621 | A | | 9/1991 | Creighton | |
| 5,092,477 | A | | 3/1992 | Johnson, Jr. | |
| 5,135,144 | A | | 8/1992 | Blakley | |
| 5,137,260 | A | | 8/1992 | Pehr | |
| 5,292,017 | A | | 3/1994 | Reifers | |
| 5,310,081 | A | | 5/1994 | McCabe | |
| 5,402,906 | A | | 4/1995 | Brown | |
| 5,443,174 | A | | 8/1995 | Bauer | |
| D362,389 | S | | 9/1995 | Frye | |
| 5,449,077 | A | * | 9/1995 | Seidler | B65D 50/045 215/221 |
| D374,822 | S | | 10/1996 | Philips | |
| D385,793 | S | | 11/1997 | Marsal | |
| 5,779,093 | A | | 7/1998 | Poole | |
| 5,836,474 | A | | 11/1998 | Wessberg | |
| 5,866,219 | A | | 2/1999 | McClure et al. | |
| D413,485 | S | | 9/1999 | Much | |
| D414,650 | S | | 10/1999 | Lillelund | |
| 5,961,000 | A | | 10/1999 | Sanfilippo | |
| 5,979,680 | A | | 11/1999 | Farside | |
| D421,909 | S | | 3/2000 | Opresco | |
| 6,053,347 | A | | 4/2000 | Fullin | |
| 6,152,751 | A | | 11/2000 | Hanson | |
| D437,776 | S | | 2/2001 | Pullan | |
| 6,237,818 | B1 | | 5/2001 | Kline | |
| 6,276,853 | B1 | | 8/2001 | Breidenbach | |
| D448,995 | S | | 10/2001 | McDonald | |
| 6,439,409 | B1 | * | 8/2002 | Dressel | B65D 50/046 215/209 |
| 6,532,965 | B1 | | 3/2003 | Abhulimen | |
| 6,596,328 | B1 | | 7/2003 | Bezek et al. | |
| 6,793,081 | B1 | | 9/2004 | Derman | |
| 6,874,649 | B2 | | 4/2005 | Clark | |
| 6,923,333 | B2 | | 8/2005 | Arciniegas | |
| 7,040,487 | B2 | | 5/2006 | Zabka et al. | |
| 7,093,710 | B2 | | 8/2006 | Shimizu | |
| 7,111,746 | B2 | | 9/2006 | Miceli | |
| D540,169 | S | | 4/2007 | Tanner | |
| 7,231,923 | B2 | | 6/2007 | Adiga | |
| D585,489 | S | | 1/2009 | Han | |
| 7,475,787 | B2 | | 1/2009 | Gruver | |
| 7,581,899 | B2 | | 9/2009 | May | |
| D604,942 | S | | 12/2009 | Smith | |
| D610,006 | S | | 2/2010 | Ortell | |
| 7,798,319 | B1 | | 9/2010 | Bried | |
| 7,845,505 | B2 | | 12/2010 | Hamamoto | |
| D639,337 | S | | 6/2011 | Hung | |
| D639,338 | S | | 6/2011 | Hung | |
| D641,628 | S | | 7/2011 | Baughman | |
| D653,281 | S | | 1/2012 | Shih | |
| D655,605 | S | | 3/2012 | Baughman | |
| D656,192 | S | | 3/2012 | Chen | |
| D656,545 | S | | 3/2012 | Hung | |
| D664,035 | S | | 7/2012 | Hu | |
| 8,240,492 | B2 | | 8/2012 | Mileti | |
| D667,876 | S | | 9/2012 | Xie | |
| D669,123 | S | | 10/2012 | Jiang | |
| D669,124 | S | | 10/2012 | Jiang | |
| 8,573,426 | B2 | | 5/2013 | Maness | |
| D689,735 | S | | 9/2013 | Redfern | |
| D698,652 | S | | 2/2014 | Sommer | |
| D704,066 | S | | 5/2014 | de Lima Paschoal | |
| 8,746,240 | B2 | | 6/2014 | Terry | |
| 8,863,947 | B2 | | 10/2014 | Sibley et al. | |
| D717,104 | S | | 11/2014 | Redfern | |
| 8,910,640 | B2 | | 12/2014 | Sears | |
| D721,202 | S | | 1/2015 | Liu | |
| D725,310 | S | | 3/2015 | Eksouzian | |
| D727,172 | S | | 4/2015 | Rosella | |
| D732,733 | S | | 6/2015 | Spagnolo | |
| D739,597 | S | | 9/2015 | Lavanchy | |
| D739,598 | S | | 9/2015 | Lavanchy | |
| 9,259,035 | B2 | | 2/2016 | Terry | |
| 9,265,287 | B2 | | 2/2016 | Sims | |
| D751,902 | S | | 3/2016 | Sturk | |
| 9,352,288 | B2 | | 5/2016 | Terry | |
| D770,677 | S | | 11/2016 | Van Keppel | |
| D774,887 | S | | 12/2016 | Torrison | |
| D775,279 | S | | 12/2016 | Shen | |
| D777,034 | S | | 1/2017 | Siller | |
| D788,697 | S | | 6/2017 | Verleur | |
| 9,696,949 | B2 | | 7/2017 | Hendricks et al. | |
| 9,743,691 | B2 | | 8/2017 | Minskoff | |
| D800,566 | S | | 10/2017 | Wieland | |

(56) References Cited

U.S. PATENT DOCUMENTS

| | | | | |
|---|---|---|---|---|
| D804,306 | S | 12/2017 | Simons | |
| D808,580 | S | 1/2018 | Kwitel | |
| 9,878,821 | B2 | 1/2018 | Sibley et al. | |
| D812,428 | S | 3/2018 | Wu | |
| 9,913,490 | B2 | 3/2018 | Clark | |
| 9,936,729 | B2 | 4/2018 | Garcia | |
| 9,950,844 | B2 | 4/2018 | Barber | |
| 9,968,127 | B2 | 5/2018 | Han | |
| 9,999,250 | B2 | 6/2018 | Minskoff | |
| D826,470 | S | 8/2018 | Huang | |
| D828,158 | S | 9/2018 | Manis | |
| 10,124,941 | B2 | 11/2018 | Sibley et al. | |
| D53,092 | S | 3/2019 | Swanson | |
| D859,143 | S | 9/2019 | Perdue | |
| D861,979 | S | 10/2019 | Sibley | |
| D865,439 | S | 11/2019 | Matsumoto | |
| 10,463,075 | B2 | 11/2019 | Beardsall | |
| D876,232 | S | 2/2020 | Sibley | |
| 10,597,205 | B2 | 3/2020 | Sibley | |
| D891,175 | S | 7/2020 | Martin | |
| 10,954,042 | B2 * | 3/2021 | French | B65D 50/00 |
| 1,410,515 | A1 | 3/2022 | Luther | |
| 1,463,856 | A1 | 8/2023 | Christian | |
| 2002/0148833 | A1 | 10/2002 | Simon | |
| 2002/0169635 | A1 | 11/2002 | Shillinburg | |
| 2005/0092751 | A1 | 5/2005 | Alvares | |
| 2005/0145627 | A1 * | 7/2005 | Stull | B65D 50/046 220/326 |
| 2005/0173272 | A1 | 8/2005 | Lemmons | |
| 2006/0060578 | A1 | 3/2006 | Church et al. | |
| 2006/0144726 | A1 | 6/2006 | Foust | |
| 2006/0231447 | A1 | 10/2006 | Fensham | |
| 2007/0034595 | A1 | 2/2007 | Foster | |
| 2007/0062952 | A1 * | 3/2007 | Kobayashi | B29C 57/02 220/288 |
| 2008/0052044 | A1 | 2/2008 | Shoenfeld | |
| 2008/0149584 | A1 | 6/2008 | Martinelli | |
| 2008/0202956 | A1 | 8/2008 | Welk | |
| 2008/0283527 | A1 * | 11/2008 | Allen | B65D 43/0212 220/253 |
| 2008/0314916 | A1 | 12/2008 | Dimartino | |
| 2009/0212004 | A1 | 8/2009 | Metzger et al. | |
| 2009/0266736 | A1 | 10/2009 | Sprishen et al. | |
| 2009/0314299 | A1 | 12/2009 | Kilpatrick | |
| 2010/0031968 | A1 | 2/2010 | Sheikh | |
| 2010/0083959 | A1 | 4/2010 | Siller | |
| 2010/0101186 | A1 | 4/2010 | Cronin | |
| 2010/0175639 | A1 | 7/2010 | Sibley | |
| 2010/0307113 | A1 | 12/2010 | Bried et al. | |
| 2011/0023895 | A1 | 2/2011 | Wang | |
| 2011/0174639 | A1 | 7/2011 | Sibley et al. | |
| 2011/0277764 | A1 | 11/2011 | Terry | |
| 2011/0303566 | A1 | 12/2011 | Gibson | |
| 2011/0308986 | A1 | 12/2011 | Lee | |
| 2012/0037654 | A1 | 2/2012 | McNamara | |
| 2012/0064468 | A1 | 3/2012 | Sibley et al. | |
| 2012/0318283 | A1 | 12/2012 | Watanabe | |
| 2012/0318882 | A1 | 12/2012 | Abehasera | |
| 2013/0015215 | A1 | 1/2013 | Coote | |
| 2013/0105482 | A1 | 5/2013 | Letica, II et al. | |
| 2013/0008809 | A1 | 10/2013 | Cortez | |
| 2014/0096781 | A1 | 4/2014 | Sears | |
| 2014/0283858 | A1 | 9/2014 | Liu | |
| 2014/0283859 | A1 | 9/2014 | Minskoff | |
| 2015/0034104 | A1 | 2/2015 | Zhou | |
| 2015/0048169 | A1 | 2/2015 | Doberschutz | |
| 2015/0136618 | A1 | 5/2015 | Patel | |
| 2015/0253055 | A1 | 9/2015 | Tsui | |
| 2015/0290699 | A1 | 10/2015 | Claydon | |
| 2015/0320114 | A1 | 11/2015 | Wu | |
| 2015/0374036 | A1 | 12/2015 | Suzuki | |
| 2016/0016700 | A1 | 1/2016 | Stevens | |
| 2016/0016715 | A1 | 1/2016 | Crawford et al. | |
| 2016/0031627 | A1 | 2/2016 | Yeh | |
| 2016/0046415 | A1 | 2/2016 | Buck | |
| 2016/0167845 | A1 | 6/2016 | Harvey | |
| 2016/0273789 | A1 * | 9/2016 | Gwen | F24F 3/1411 |
| 2016/0331912 | A1 | 11/2016 | Trzecieski | |
| 2016/0360782 | A1 | 12/2016 | Barrantes | |
| 2017/0113851 | A1 * | 4/2017 | Martin | B65D 50/046 |
| 2017/0215478 | A1 | 8/2017 | Harrison | |
| 2017/0253408 | A1 | 9/2017 | Strassburger | |
| 2017/0258142 | A1 | 9/2017 | Hatton | |
| 2017/0305615 | A1 | 10/2017 | Witt | |
| 2017/0355495 | A1 | 12/2017 | Martin et al. | |
| 2018/0042302 | A1 | 2/2018 | Robinson | |
| 2018/0098571 | A1 | 4/2018 | Watson | |
| 2018/0117268 | A1 | 5/2018 | Selby | |
| 2018/0153221 | A1 | 6/2018 | Verleur | |
| 2018/0177234 | A1 | 6/2018 | Lee | |
| 2018/0319556 | A1 | 11/2018 | Straughan | |
| 2019/0276202 | A1 | 9/2019 | Wilson | |
| 2019/0315532 | A1 | 10/2019 | Boggs | |
| 2020/0140156 | A1 | 5/2020 | Combs | |
| 2021/0102829 | A1 | 4/2021 | Woolery | |
| 2021/0122539 | A1 | 4/2021 | Martin et al. | |
| 2022/0234796 | A1 | 7/2022 | Martin | |

OTHER PUBLICATIONS

Examination report No. 1 dated Feb. 7, 2018 in Australian Patent Application No. 2015339764, 6 pages.
Final Office Action dated Dec. 9, 2019 in U.S. Appl. No. 16/186,880, 5 pages.
Final Office Action dated Jun. 13, 2014 in U.S. Appl. No. 13/233,931, 10 pages.
Final Office Action dated Mar. 4, 2022 in U.S. Appl. No. 15/616,483, 13 pages.
International Search Report and Written Opinion dated Aug. 24, 2018 in International Application No. PCT/US18/33561, 11 pages.
International Search Report and Written Opinion dated Feb. 3, 2020 in International Application No. PCT/US19/60661, 7 pages.
International Search Report and Written Opinion dated Jan. 8, 2016 in International Application No. PCT/US15/56158, 9 pages.
International Search Report and Written Opinion dated Sep. 29, 2021 in International Application No. PCT/US21/29627, 15 pages.
Non-Final Office Action dated Apr. 6, 2020 in U.S. Appl. No. 29/667,732, 11 pages.
Non-Final Office Action dated Feb. 9, 2017 in U.S. Appl. No. 14/519,031, 8 pages.
Non-Final Office Action dated Oct. 8, 2013 in U.S. Appl. No. 13/233,931, 10 pages.
Non-Final Office Action dated Sep. 12, 2017 in U.S. Appl. No. 14/519,031, 7 pages.
Non-Final Office Action dated Sep. 18, 2019 in U.S. Appl. No. 16/186,880, 7 pages.
Non-Final Office Action dated Sep. 4, 2018 in U.S. Appl. No. 29/621,608, 10 pages.
Notice of Allowance dated Aug. 21, 2014 in U.S. Appl. No. 13/233,931, 810 pages.
Notice of Allowance dated Dec. 18, 2019 in U.S. Appl. No. 29/659,000, 3 pages.
Notice of Allowance dated Jan. 27, 2020 in U.S. Appl. No. 16/186,880, 5 pages.
Notice of Allowance dated Jun. 1, 2020 in U.S. Appl. No. 29/667,732, 7 pages.
Notice of Allowance dated May 13, 2019 in U.S. Appl. No. 29/621,608, 3 pages.
Notice of Allowance dated Nov. 21, 2017 in U.S. Appl. No. 14/519,031, 8 pages.
Notice of Allowance dated Sep. 18, 2018 in U.S. Appl. No. 15/882,962, 6 pages.
Office Action dated Jan. 13, 2020 in European Patent Application No. 15854441.1, 3 pages.
Office Action dated Jan. 17, 2022 in Colombian Patent Application No. NC2021/0007365, 19 pages.
Office Action dated Mar. 13, 2019 in European Patent Application No. 15854441.1, 3 pages.

(56) References Cited

OTHER PUBLICATIONS

Supplementary European Search Report dated Mar. 23, 2018 in European Patent Application No. 15854441.1, 7 pages.
Supplementary European Search Report dated Jul. 5, 2022 in European Patent Application No. 19885694.0, 8 pages.
You Tube. N2Packagaing Systems LLC, Check the Boxes, May 7, 2019. Available at www.youtube.com/watch?v=b6zqSmkWX5I.
Non-Final Office Action dated Aug. 31, 2023 in U.S. Appl. No. 17/724,383, 5 pages.
Non-Final Office Action dated May 15, 2023 in U.S. Appl. No. 17/140,565, 8 pages.
Notice of Allowance dated Sep. 18, 2023 in U.S. Appl. No. 17/140,565, 7 pages.
Notice of Allowance dated Nov. 1, 2023 in U.S. Appl. No. 17/724,383, 7 pages.

* cited by examiner

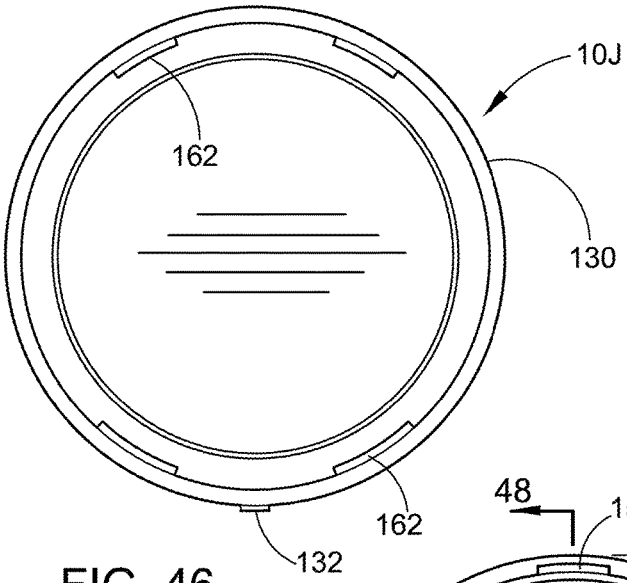
FIG. 46
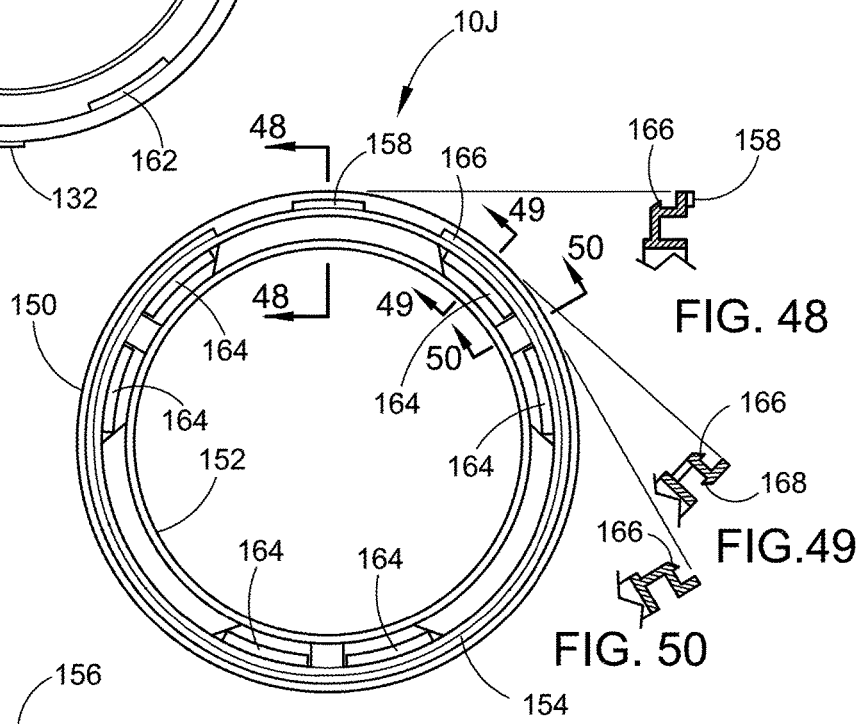
FIG. 48
FIG.49
FIG. 50
FIG. 47
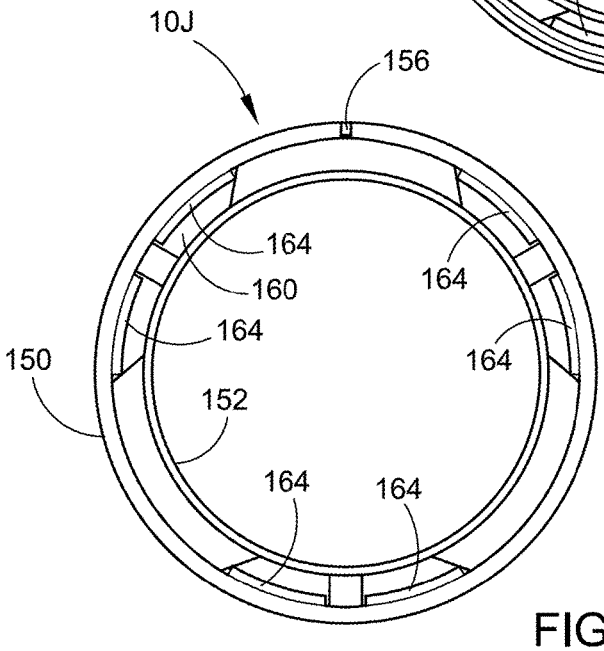
FIG. 51

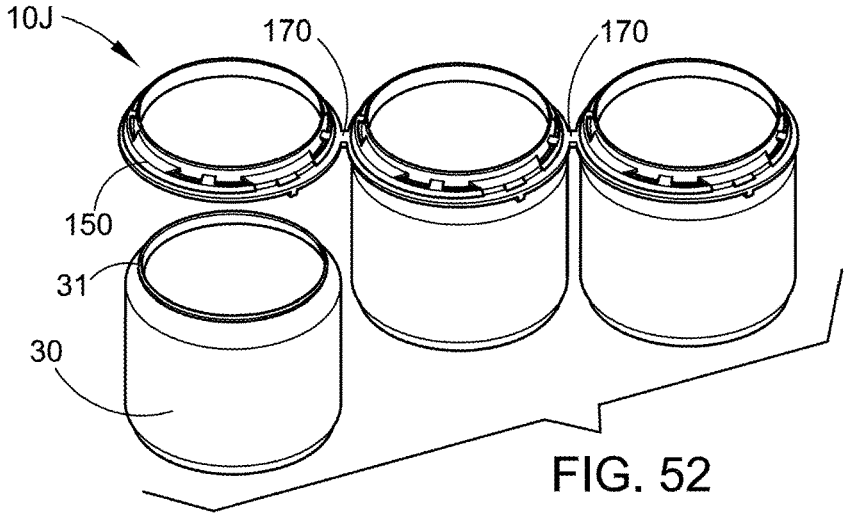
FIG. 52
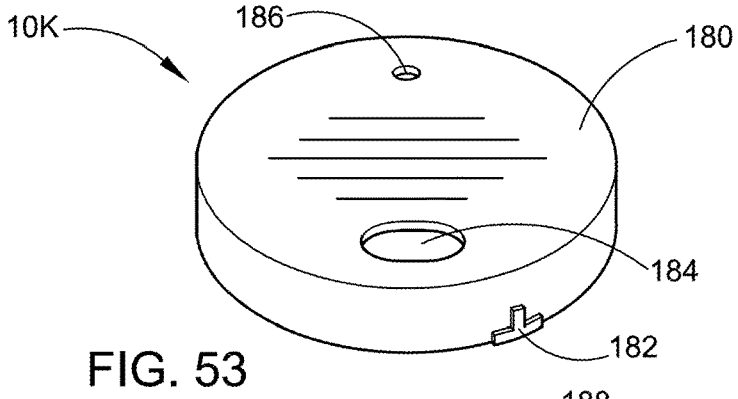
FIG. 53
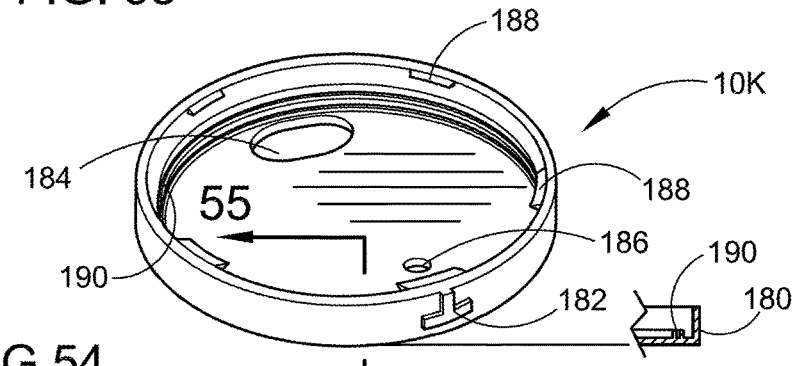
FIG.54
FIG. 55
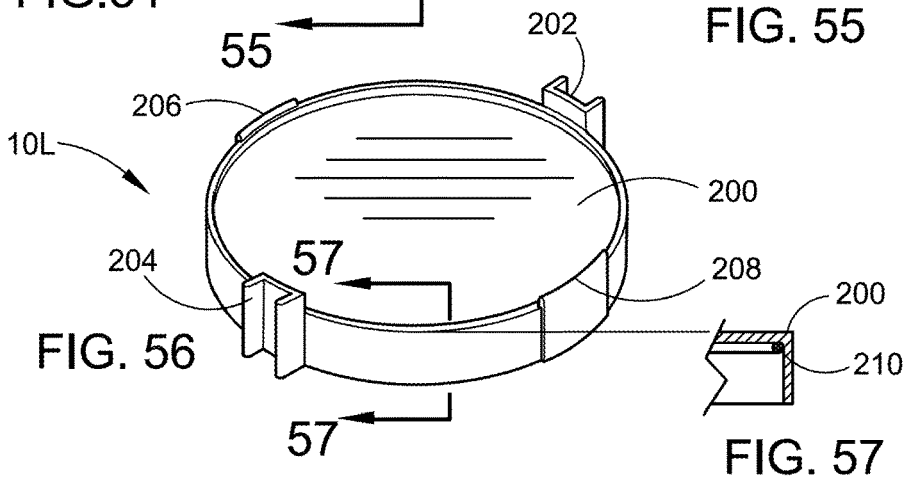
FIG. 56
FIG. 57

CHILD RESISTANT DOUBLE SEAM CONTAINER LID

FIELD OF THE INVENTION

This application provides a child resistant double seam container lid including an adapter ring for securely affixing to the double seam top rim of conventional double seamed containers that will be difficult for children to open, yet readily openable by adults. More particularly, a one-piece, two-piece, and three-piece child resistant double seam affixable container lid is provided having a first piece lid portion first, a second piece adapter ring locking member second piece and optionally a third piece securing unit piece, with rotational alignment indicators, and optional additional integral features such as a liquid measuring cup feature, a liquid tight lid feature, a threaded lid portion, a replaceable double seam container lid portion and a double seam container lid locking member adapter ring securely affixable to the double seam container.

BACKGROUND OF THE INVENTION

Canning is the process of preserving a product by processing and sealing it in an airtight metal can. Cans are typically either two-piece or three-piece cans. In the case of a two-piece can, a can body is formed by punching a metal plate to form a cylinder closed at one end. The can is then filled and the open end closed by seaming a lid to the can body during the canning process. In the case of a three-piece can, a can body, open at both ends, is formed by rolling and seaming a metal plate. A first end is closed by seaming a lid to the can body. The can is then filled and the second end closed by seaming a lid to the can body during the canning process.

Once these cans are opened with a conventional can opener, and they are difficult to reseal adequately. In some cases, individuals do not want cans to be opened easily by children where they could be carrying a harmful substance. Thus, there needs to be developed a can lid that is child resistant and can be initially installed on a can to be removed by an adult and then the child resistant lid can be put back on the can in the same condition where a child could still not be able remove it.

Numerous innovations for a Child Resistant Can Lid have been provided in the prior art that are described as follows. Even though these innovations may be suitable for the specific individual purposes to which they address, they differ from the present design as hereinafter contrasted. The following is a summary of those prior art patents most relevant to this application at hand, as well as a description outlining the difference between the features of the Child Resistant Can Lid and the prior art.

US Patent Application Publication No. 2006/0060578 A1 of John R. Church et al. describes a secure locking container and lid assembly, including a resilient plastic container and lid, are closed by snap-lock engagement of the lid in a locking groove in the interior of the container mouth making it virtually impossible to manually remove the lid without damaging the container assembly or the product therein.

This patent describes a resilient plastic container and lid but does not describe a lid for a can that is difficult for a child to attempt to remove and may be easily removed and securely put back on by an adult.

US Patent Application Publication No. 2015/0290699 A1 of Paul Charles Claydon, which patent application publication is hereby incorporated by reference herein, describes a process for closing a metal can body, suitable for containing an edible product, with a can lid, to provide a metal can suitable for heating in a retort. The process comprises: placing a metal lid over and in contact with an open end of a metal can body; applying an inwardly directed mechanical force to the lid such that at least a central portion of the lid is deformed into the interior space of the metal can body; and seaming the lid to the can body to form an airtight seal between the lid and the can body.

This patent describes a process for closing a metal can body but does not deal with a removable and resealable metal child resistant can lid.

None of these previous efforts, however, provides the benefits attendant with the Child Resistant Double Seam Container Lid. The present design achieves its intended purposes, objects and advantages over the prior art devices through a new, useful and unobvious combination of method steps and component elements, with the use of a minimum number of functioning parts, at a reasonable cost to manufacture, and by employing readily available inexpensive materials.

SUMMARY OF THE INVENTION

The principle advantage of the preferred embodiment of the Child Resistant Double Seam Container Lid is that they cannot be easily opened in a conventional manner by a child, yet is readily openable by adults, especially senior adults.

Another advantage of the Child Resistant Double Seam Container Lid is that it can be configured in a one-piece, two-piece and three-piece lid, including an upper lid portion top piece and lower adapter ring locking member piece.

Another advantage of the Child Resistant Double Seam Container Lid is that it can be constructed with features making it liquid tight.

Another advantage of the Child Resistant Double Seam Container Lid is that it can be configured to include a measuring cup integral with the lid top portion or it may include a measuring cup which is provided as a separate removeable piece.

Another advantage of the Child Resistant Double Seam Container Lid is that an adapter ring locking member piece is provided which is capable of being secured to the double seam.

Another advantage of the Child Resistant Double Seam Container Lid is that the lid portion top piece and the adapter ring locking member piece are round and may include rotational indicators which when aligned allow for the lid portion top piece to be removed.

Another advantage of the Child Resistant Double Seam Container Lid is that the one-piece lids may be provided with finger grips and container retaining guides to allow for stable container stacking.

Another advantage of the Child Resistant Double Seam Container Lid is that it will provide for a child resistant lid portion top piece and adapter ring locking member piece affixable to a beverage container double seam.

Another advantage of the Child Resistant Double Seam Container Lid is that it will provide a locking member adapter ring piece which includes retaining teeth to secure the locking member adapter ring piece to a container double seam.

Another advantage of the Child Resistant Double Seam Container Lid is that it will provide for a child resistant lid portion top piece and adapter ring locking member piece affixable to a conventional product can container double seam.

Another advantage of the Child Resistant Double Seam Container Lid is that it may provide a securing unit affixable to the locking member adapter ring piece to lock the locking member adapter ring piece in place on the double seam of the container.

Another advantage of the Child Resistant Double Seam Container Lid is that it may have a rubber sealant coating applied to the lid inner surface, with the vacuum sealing can locking member adapter ring piece having the rubber sealant applied on the inner surface, making the container liquid tight and vacuum sealable.

Another advantage of the Child Resistant Double Seam Container Lid is that it may incorporate a threaded attachment between the lid portion top piece and the vacuum sealable can locking member adapter ring piece.

The preferred embodiment of the Child Resistant Double Seam Container Lid will be comprised of two parts, with those two pieces being a lid portion top piece and an adapter ring can locking member piece, both of which will be round in shape. The adapter ring can locking member piece has an external locking trough around its round circumference with a narrow relief area therein. The lid portion top piece has a mating locking inner portion that engages within the external locking trough in the adapter ring can locking member with a locking nib that when located next to the relief area in the can be pressed upward to remove the lid. An upper portion of a rotational alignment indicator is located on the can lid portion top piece and an opposing rotational alignment indicator is located on the adapter ring can locking member piece.

The lid portion top piece is round, and can be rotated about the adapter ring can locking member, which is also round, so that the locking nib does not align with the relief area and the can will remain locked until the lid portion top piece is again rotated until the two parts of the rotational alignment indicator sections come together. Preferably, fourteen (14) retaining teeth on the inner lower edge of the adapter ring can locking member will be forced over the double seam and will engage under the double seam can top rim to lock the Child Resistant Double Seam Container Lid to the can. The number of retaining teeth can be varied from about 14 to 25 teeth. Once the adapter ring can locking member retaining teeth is snapped onto the double seam it will be securely affixed and is not removeable without breaking the adapter ring locking member.

The preferred embodiment of the Child Resistant Double Seam Container Lid will have a lid portion top piece which is tapered, with smooth sides to make the lid portion top piece difficult for a child to grasp, and a sealing ledge on the cap inside surface to grab the seam roll of the upper edge of the can. The lid sealing ledge is relieved in two areas ninety degrees apart leaving a ridge to maintain a seal when the lid is attached to a can. The lid will flex when it is pushed up where the indicia "PUSH UP" and the lifting protrusion are located with a small tab located below to make it easier for adults to remove the cap.

An alternate embodiment of the Child Resistant Double Seam Container Lid will be comprised of three parts, with those three pieces being the lid portion top piece, the can locking member adapter ring piece and the adapter ring securing unit piece. The lid portion top piece has a mating locking inner portion that engages within the trough in the can locking member adapter ring piece with a locking nib that when located next to the relief area in the can be pressed upward to remove the lid portion top piece. The securing unit adapter ring piece has a plurality of wedge shaped teeth that are pressed between the can locking member adapter ring piece and the lid portion top piece of the can double seam to further secure Child Resistant Double Seam Container Lid to the can double seam.

An alternate embodiment of the Child Resistant Double Seam Container Lid will have a rubber sealant coating applied to the lid inner surface, with the vacuum sealing can locking member having the rubber sealant applied on the inner surface of the edges of both the lid portion piece and the adapter ring locking member piece.

An alternate embodiment of the Child Resistant Double Seam Container Lid will incorporate a threaded attachment between the lid and the Vacuum sealing can locking member. The vacuum sealing can locking member puts pressure on the rubber sealing coating on the side and top of the can rim when the retaining teeth are locked under the can rim. When the lid is tightened down it puts pressure on the rubber sealing coating on the lid and the vacuum sealing can locking member. The lid has a bulbous area on the outer edge with a plurality gripping ribs around the perimeter to aid in tightening down the lid. A second set of gripping ribs are on the perimeter of the Vacuum sealing can locking member helps in tightening the lid. A flexible locking tab is located on one of the gripping ribs to engage with one of the gripping ribs that can be bent upward to release the lid to rotate and open the can. By pressing down on the lid, a partial vacuum will be achieved within the can.

An alternate embodiment of the Child Resistant Double Seam Container Lid will provide an adapter ring locking member piece capable of receiving a measuring cup therein.

An alternate embodiment of the Child Resistant Double Seam Container Lid will provide an adapter ring locking member piece capable of being combined and attached together with a frangible attachment point, and configured in 3-pack, 4-pack, 6-pack, 8-pack and more beverage or food container combinations.

An alternate embodiment of the Child Resistant Double Seam Container Lid will provide an adapter ring locking member piece which will have a retractable and extendable push tab to increase the leverage in opening or removing the lid portion top piece.

An alternate embodiment of the Child Resistant Double Seam Container Lid will provide an adapter ring locking member piece secured to a double seam can top rim which can be configured to accept a varying number of different lid portion top pieces which have been specifically configured to be child resistant in differing ways, and openable and closable when the rotational alignment indicators are properly aligned for removal.

With respect to the above description then, it is to be realized that the optimum dimensional relationships for the parts of this application, to include variations in size, materials, shape, form, function and manner of operation, assembly and use, are deemed readily apparent and obvious to one skilled in the art. All equivalent relationships to those illustrated in the drawings and described in the specification intend to be encompassed by the present disclosure. Therefore, the foregoing is considered as illustrative only of the principles of the Child Resistant Double Seam Container Lid. Further, since numerous modifications and changes will readily occur to those skilled in the art, it is not desired to limit the design to the exact construction and operation shown and described, and accordingly, all suitable modifications and equivalents may be resorted to, falling within the scope of this application.

BRIEF DESCRIPTION OF THE DRAWINGS

The accompanying drawings, which are incorporated in and form a part of this specification, illustrate embodiments of the Child Resistant Double Seam Container Lid and together with the description, serve to explain the principles of this application.

FIG. 46 depicts a bottom plan view of the lid portion top piece of the three-piece Child Resistant Double Seam Container Lid incorporating a divided measuring cup shown in FIG. 42.

FIG. 47 depicts a top plan view of the adapter ring portion of the three-piece Child Resistant Double Seam Container Lid incorporating a divided measuring cup shown in FIG. 42.

FIG. 48 depicts a cross-sectional view of the adapter ring portion of the three-piece Child Resistant Double Seam Container Lid incorporating a divided measuring cup shown in FIG. 47.

FIG. 49 depicts another cross-sectional view of the adapter ring portion of the three-piece Child Resistant Double Seam Container Lid incorporating a divided measuring cup shown in FIG. 47.

FIG. 50 depicts yet another cross-sectional view of the adapter ring portion of the three-piece Child Resistant Double Seam Container Lid incorporating a divided measuring cup shown in FIG. 47.

FIG. 51 depicts a bottom plan view of the adapter ring portion of the three-piece Child Resistant Double Seam Container Lid incorporating a divided measuring cup shown in FIG. 47.

FIG. 52 depicts a top perspective view of three adapter rings connected together by a frangible connection point configured to hold three containers, showing one container below the adapter ring 3-pack and not connected thereto.

FIG. 53 depicts a top perspective view of an alternate embodiment of the Child Resistant Double Seam Container Lid illustrating a round lid portion top piece having drinking, dispensing and venting holes therein.

FIG. 54 depicts a bottom perspective view of the alternate embodiment of the Child Resistant Double Seam Container Lid illustrating a round lid portion top piece having drinking, dispensing and venting holes therein shown in FIG. 53.

FIG. 55 depicts a partial cross-sectional view of the alternate embodiment of the Child Resistant Double Seam Container Lid illustrating a round lid portion top piece having drinking, dispensing and venting holes therein shown in FIG. 54.

FIG. 56 depicts a top perspective view of an alternate embodiment of the Child Resistant Double Seam Container Lid illustrating incorporated integral finger grips and container retaining guides for facilitating stacking of containers so equipped.

FIG. 57 depicts a cross-sectional view of the alternate embodiment of the Child Resistant Double Seam Container Lid shown in FIG. 56 illustrating the position of an O-ring within the lid portion enabling a liquid tight one-piece child resistant lid with finger grips and container retaining guides.

For a fuller understanding of the nature and advantages of the Child Resistant Double Seam Container Lid, reference should be had to the following detailed description taken in conjunction with the accompanying drawings which are incorporated in and form a part of this specification, illustrate embodiments of the design and together with the description, serve to explain the principles of this application.

DETAILED DESCRIPTION OF THE PREFERRED EMBODIMENTS

Figure 1:
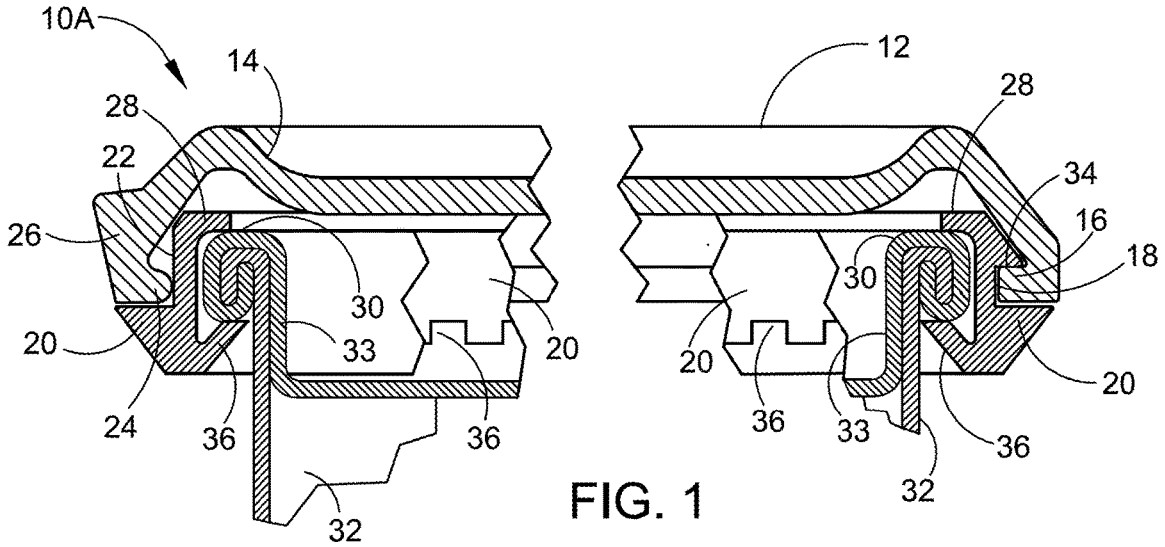
FIG. 1 depicts a cross-section of the preferred embodiment of the assembled Child Resistant Double Seam Container Lid over a conventional can double seam, in accordance with the present invention.

Referring now to the drawings, wherein similar parts of the preferred embodiment of the two-piece Child Resistant Double Seam Container Lid 10A are identified by like reference numerals, FIG. 1 depicts a cross-section of the preferred embodiment of the assembled two-piece Child Resistant Double Seam Container Lid 10A snapped on to a conventional can 32 double seamed container seam roll 30 top rim, made up of the container 32 wall and the container lid portion 33, in accordance with the present invention. The preferred embodiment of the two-piece Child Resistant Double Seam Container Lid 10A disclosed herein is comprised of two separate pieces, the first piece lid portion 12 and the second piece adapter ring can locking member 20. The adapter ring can locking member 20 snaps on to the container double seam 30 and cannot be removed following affixation. The first piece lid portion 12 is configured to be accepted by the adapter ring can locking member 20 second piece in a way that makes the lid portion adapter ring combination assembled two-piece Child Resistant Double Seam Container Lid 10A child resistant. Moreover, all of the first piece lid portions disclosed throughout this application specification are round in shape, and all of the second piece adapter ring can locking members are round in shape, as they would not properly function to rotate about each other if either of the two pieces were not round or somehow became out of round. Therefore, all pieces shown are round circular disk shaped or round ring shaped.

There is seen in FIG. 1 in further detail depicting a cross section view of the preferred embodiment of the two-piece Child Resistant Double Seam Container Lid 10A indicating the first piece lid portion 12 with a contoured surface 14 to secure additional cans for stacking. A locking inner ring 16 of the lid portion 12 engages within the external locking trough 18 in the circumference of the second piece adapter ring can locking member 20 with a relief area 22 to access the nib section 24 of the lid portion 12 for the removal of the lid portion 12 when an upward pressure is applied at the lifting indicator section 26. The top surface 28 of the can locking member 20 rests on the rim 30 of the can 32 and is held in place by the upper surface 34 of the external locking trough 18. A series of retaining teeth 36 around the lower inner surface of the can locking member 20 are bent up when the locking member 20 is forced over the top rim 30 of the can 32 to engage under the lip of the can 30.

Figure 2:
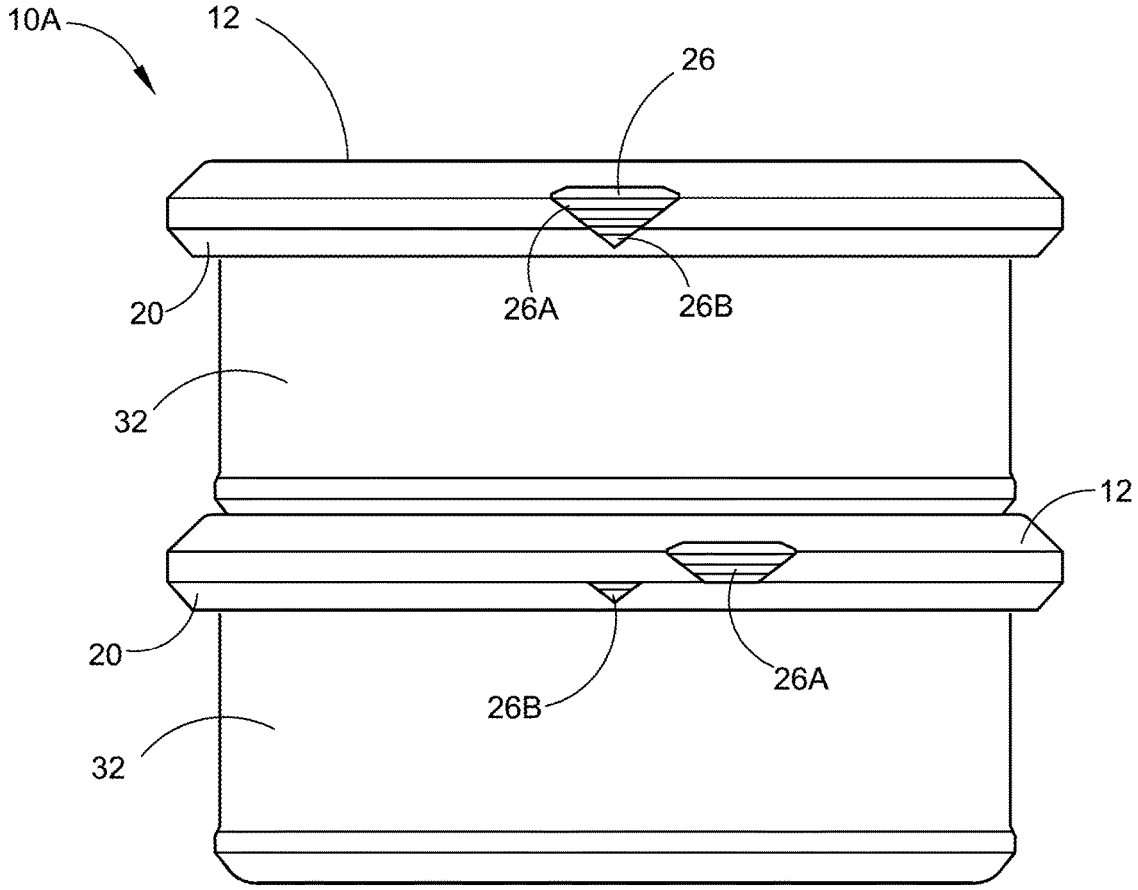
FIG. 2 depicts a side elevation view of two cans with the Child Resistant Double Seam Container Lid stacked one on top of the other having the upper can with the two parts of the indicator section in the can opening position and the lower can with the indicator section separated in the can locked position, in accordance with the present invention.

FIG. 2 depicts a side elevation view of two stacked round cans 32 with the two-piece Child Resistant Double Seam Container Lid 10A thereon, stacked one on top of the other having the upper can 32 first piece lid portion 12 with the two parts of the rotational alignment indicator section 26, namely, rotational alignment indicator 26A and rotational alignment indicator 26B aligned in the child resistant can lid opening position, in accordance with the present invention. The lower can has the lid 12 rotated so that indicator section 26A is moved to the right putting the lid 12 in the locking position. The cans are stable when stacked, as the top can rests within the contoured portion 14 (see FIG. 1) of the first piece lid portion 12, and will not slide.

Figure 3:
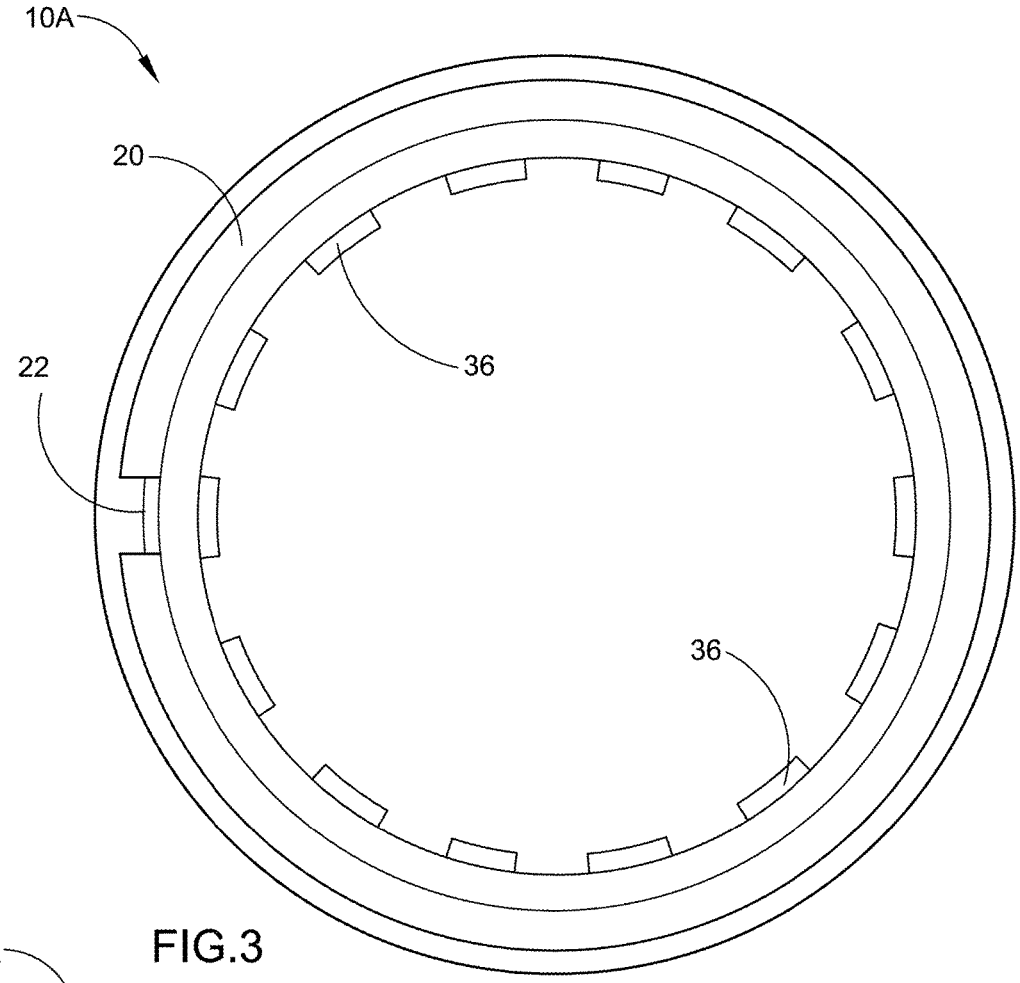
FIG. 3 depicts a top view of the can locking member of the preferred embodiment of the Child Resistant Double Seam Container Lid illustrating the plurality of retaining teeth and the relief area, in accordance with the present invention.

FIG. 3 depicts a top view of the second piece adapter ring can locking member 20 of the preferred embodiment of the two-piece Child Resistant Double Seam Container Lid 10A illustrating the plurality of retaining teeth 36 and the relief area 22, in accordance with the present invention. The plurality of retaining teeth 36 snap on to the can double seam and are thereby securely affixed to the can double seam. When the rotational indicators are aligned, the relief area 22 will allow the nib 24 to lift upwardly and the first piece lid portion 12 can be removed from the second piece adapter ring can locking member 20.

Figure 4:
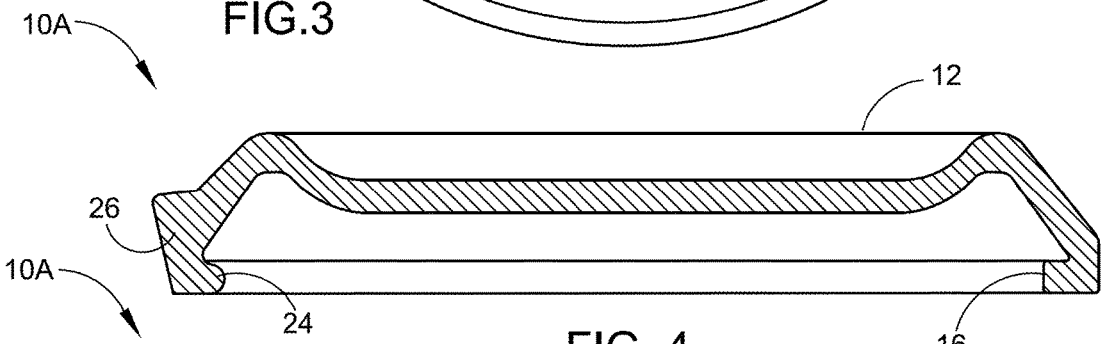
FIG. 4 depicts a cross-section through the lid portion top piece of the preferred embodiment of the Child Resistant Double Seam Container Lid illustrating the locking nib, in accordance with the present invention.

FIG. 4 depicts a cross-section through the lid portion top piece 12 of the preferred embodiment of the two-piece Child Resistant Double Seam Container Lid 10A illustrating the locking nib section 24, and the inner locking ring 16, in accordance with the present invention. The inner locking ring 16 runs around the entire circumference of the lid portion 12 except for the rotational indicator 26 area, where the locking nib section 24 is located.

Figure 5:
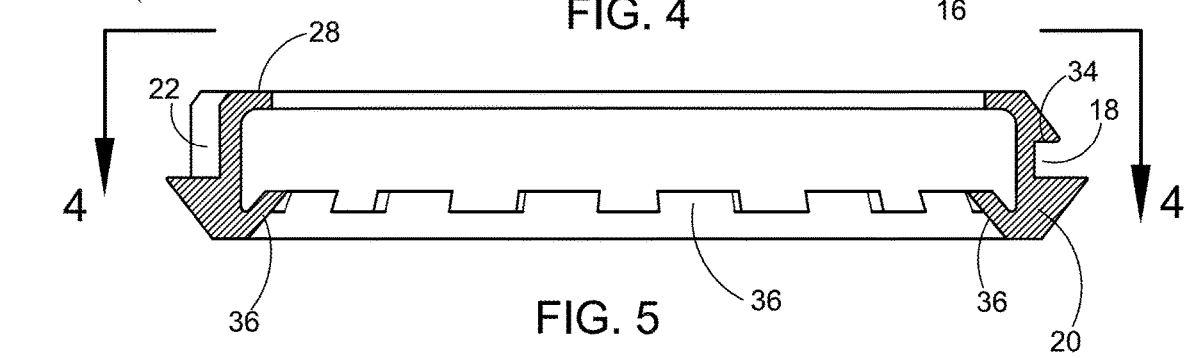
FIG. 5 depicts a cross-section through the preferred embodiment of the adapter ring can locking member piece illustrating the external locking trough, the retaining teeth and the relief area therein, in accordance with the present invention.

FIG. 5 depicts a cross-section through the preferred embodiment of the two-piece Child Resistant Double Seam Container Lid 10A showing detail of the adapter ring can locking member piece 20 illustrating the external locking trough 18 where the locking inner ring 16 is securely held in place. The top surface 28 of the can locking member 20 rests on the rim 30 of the can 32 (see FIG. 1), the fourteen (14) retaining teeth 36 are shown on the lower surface with the single relief area 22 for the nib section 24 on the left side.

Figure 6:
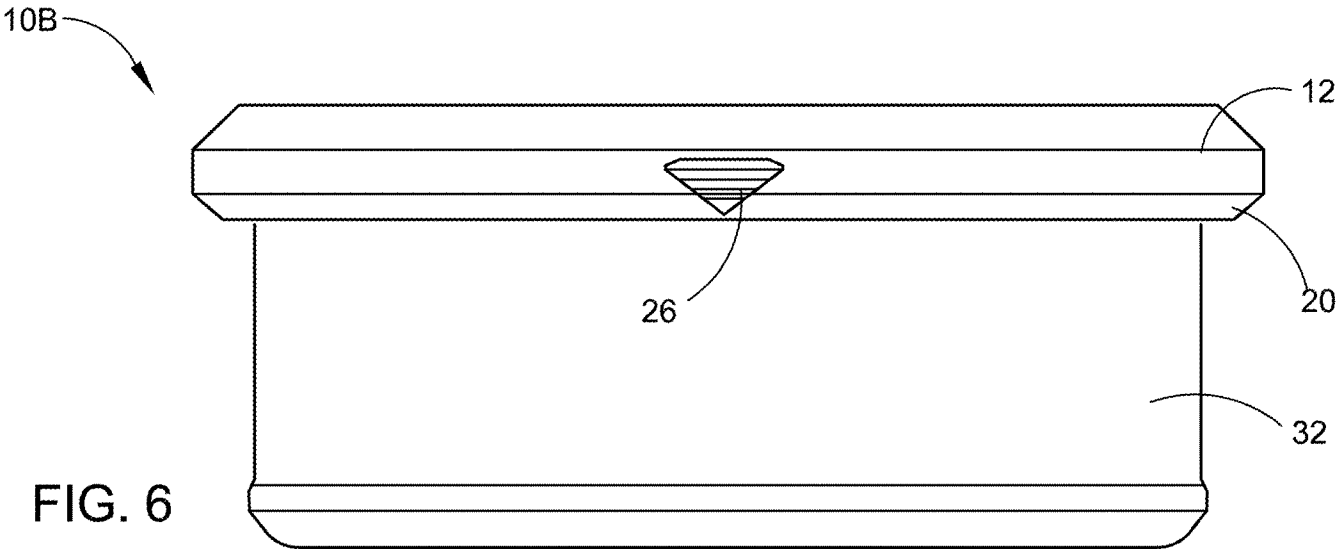
FIG. 6 depicts the first alternate embodiment Child Resistant Double Seam Container Lid illustrating a side view of a conventional can incorporating the Child Resistant Double Seam Container Lid, in accordance with the present invention.

FIG. 6 depicts the first alternate embodiment three-piece Child Resistant Double Seam Container Lid 10B, illustrating a side view of a conventional can 32 incorporating the Child Resistant Double Seam Container Lid 10B lid portion 12 and adapter ring 20, having the rotational alignment indicators within rotational indicator section 26 in alignment.

Figure 7:
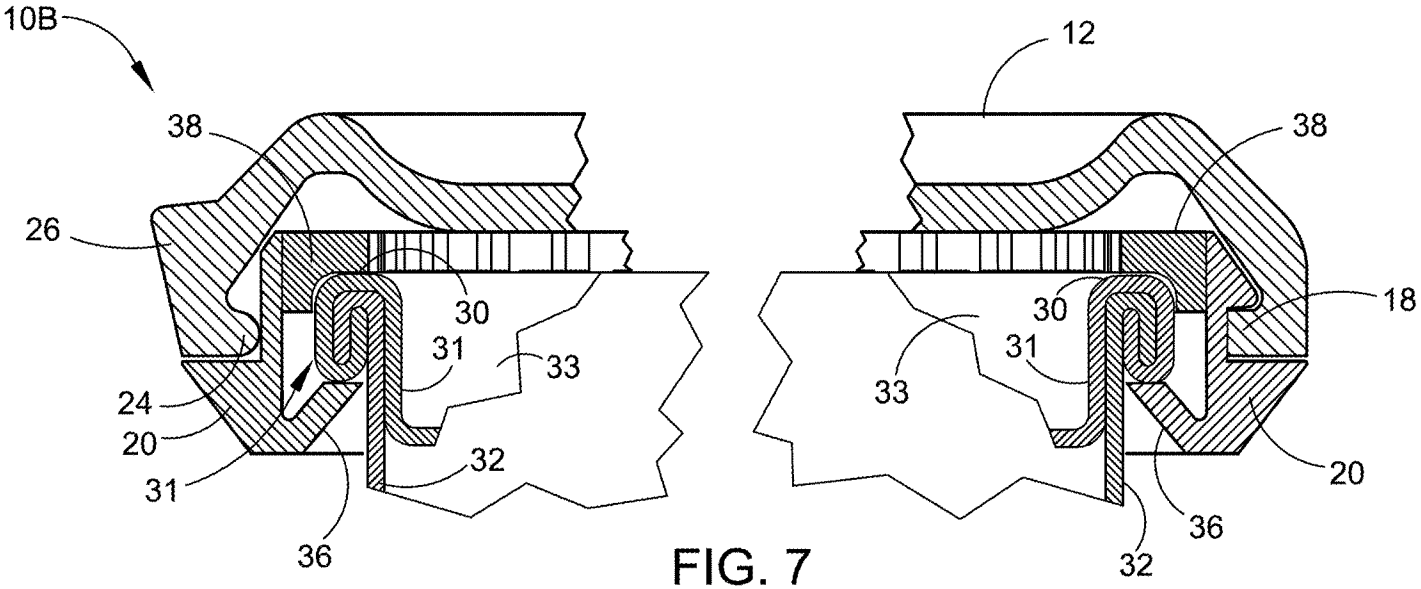
FIG. 7 depicts a cross-section through an assembled alternate embodiment of the Child Resistant Double Seam Container Lid illustrating the conventional can lid portion top piece with the locking nib section and the adapter ring can locking member piece with the addition of a securing unit third piece, in accordance with the present invention.

FIG. 7 depicts a cross-section through an assembled alternate embodiment of the three-piece Child Resistant Double Seam Container Lid 10B illustrating the conventional can lid portion first piece 12 with the locking nib section 24 and the adapter ring can locking member second piece 20 with the addition of a securing unit third piece 38. The securing unit third piece 38 secures the adapter ring can locking member second piece 20 to the double seam of the can 30, such that, when in place, the adapter ring 20 and securing unit 38 combination prevents the adapter ring 20 from being removed from the double seam 30 after affixation.

Figure 8:
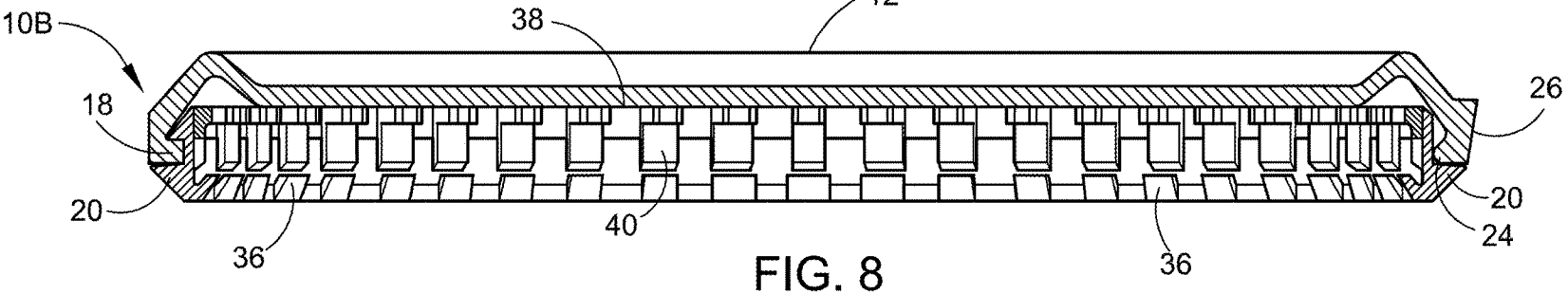
FIG. 8 depicts a cross-section through an assembled alternate embodiment of the Child Resistant Double Seam Container Lid, illustrating the adapter ring can locking member piece with external locking trough and retaining teeth along with wedge teeth on the securing unit third piece, in accordance with the present invention.

FIG. 8 depicts a cross-section through an assembled alternate embodiment of the three-piece Child Resistant Double Seam Container Lid 10B, illustrating greater detail of the lid portion first piece 20, the adapter ring can locking member second piece 20 with external locking trough 18 and a plurality of retaining teeth 36 along with a plurality of wedge teeth 40 on the securing unit 38 third piece.

Figure 9:
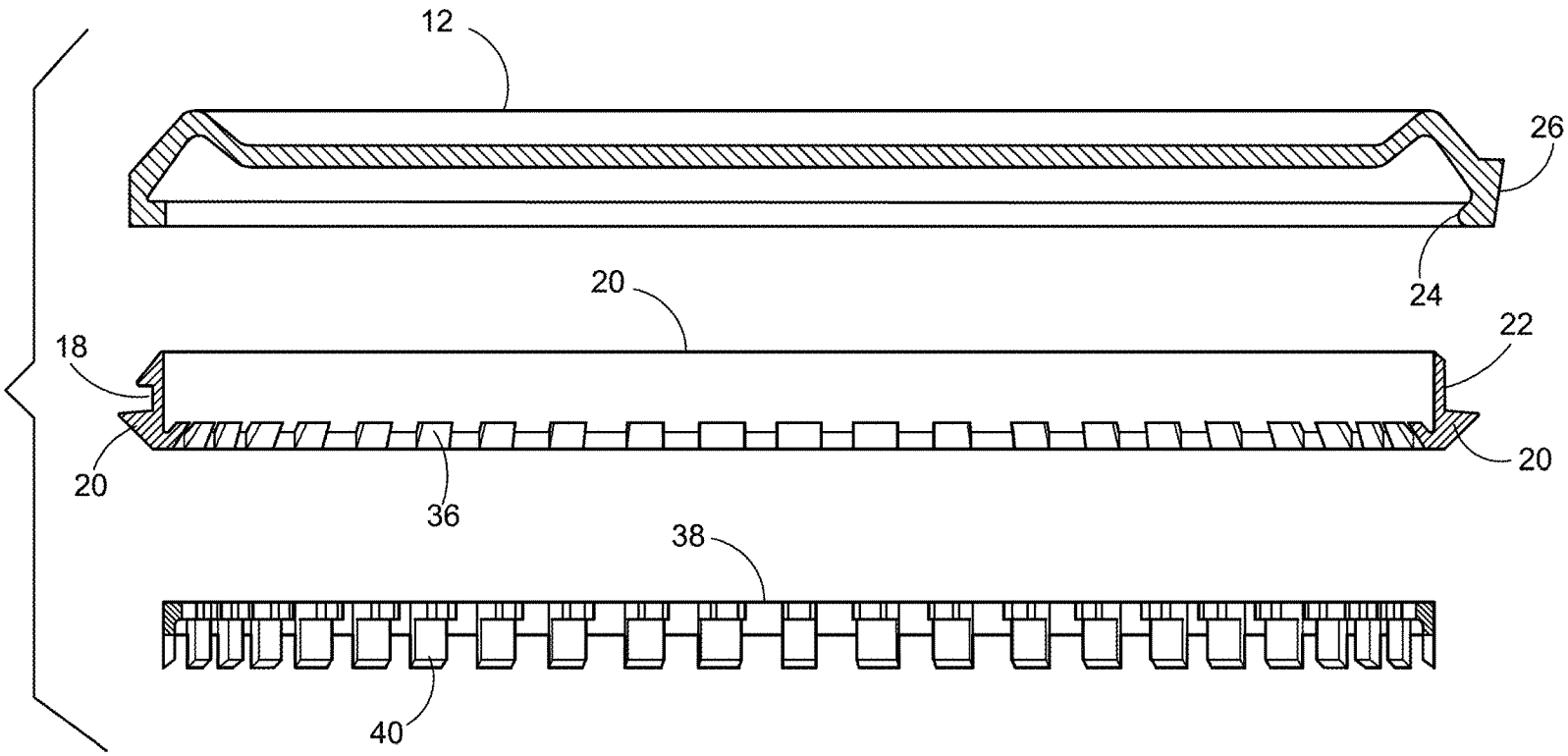
FIG. 9 depicts an exploded cross-section through separate alternate embodiments of the Child Resistant Double Seam Container Lid, illustrating the adapter ring can locking member piece with retaining teeth and wedge teeth on the securing unit third piece, in accordance with the present invention.

FIG. 9 depicts an exploded cross-section through separate alternate embodiments of the three-piece Child Resistant Double Seam Container Lid 10B, illustrating the lid portion first piece 12, the adapter ring can locking member second piece 20 with a plurality of retaining teeth 36 and the location of a plurality of wedge teeth 40 on the securing unit third piece 38, in accordance with the present invention.

Figure 10:
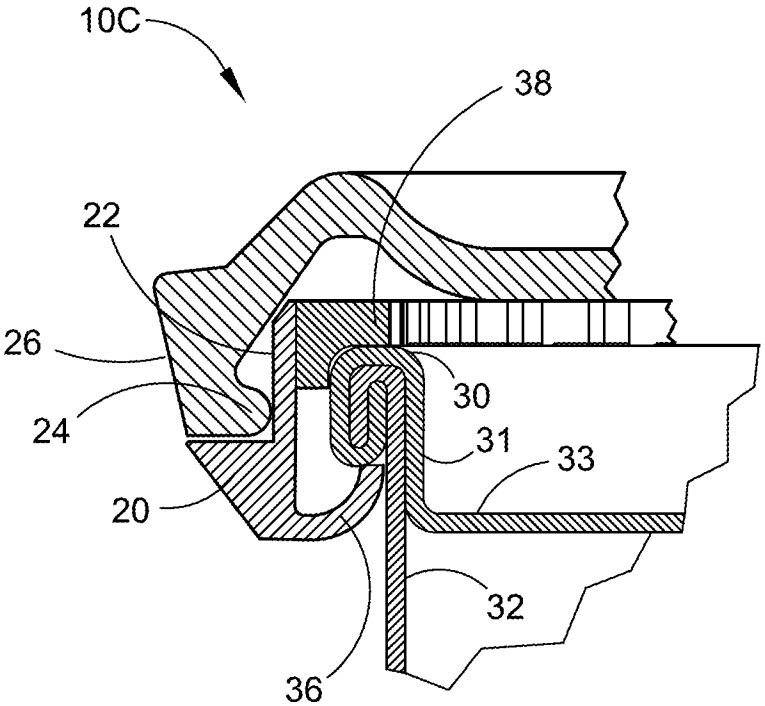
FIG. 10 is an enlarged partial cross-section through an assembled alternate embodiment of the Child Resistant Double Seam Container Lid illustrating a lid portion top first piece, the adapter ring can locking member second piece with an external locking trough and a relief area for the locking nib, wherein the retaining teeth on the adapter ring can locking member will have a flexible a configuration, in accordance with the present invention.

FIG. 10 is an enlarged partial cross-section through an assembled alternate embodiment of a three-piece Child Resistant Double Seam Container Lid 10C illustrating a lid portion top first piece 12, the adapter ring can locking member second piece 20 with an external locking trough 18 and a relief area 22 for the locking nib 24 to lift out when opening the lid portion first piece 12. The plurality of retaining teeth 36 on the adapter ring can locking member 20 will have a flexible curved configuration in this embodiment, in accordance with the present invention. The twenty four (24) retaining teeth 36 on the can locking member 20 will be curved in shape not straight, and have a thinner cross-section for a more flexible configuration. As shown here in FIG. 10, the rotational indicators 26 are aligned to allow the locking nib 24 to be lifted thereby removing the child resistant lid portion 12.

Figure 11:
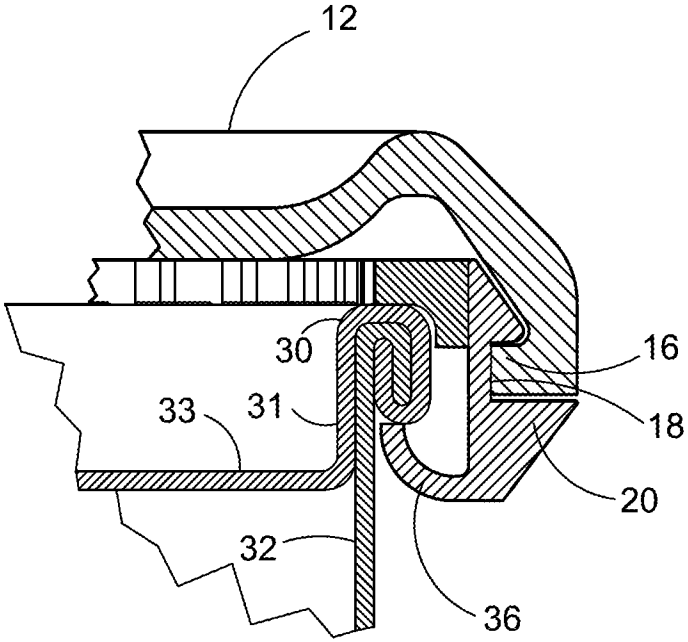
FIG. 11 is an enlarged partial cross-section through the assembled alternate embodiment of the Child Resistant Double Seam Container Lid illustrating a conventional lid portion top piece with an internal locking inner protrusion, the adapter ring can locking member piece with an external locking trough for accepting the locking nib and having a different configuration of the retaining teeth and the securing unit piece, in accordance with the present invention.

FIG. 11 is an enlarged partial cross-section through the assembled alternate embodiment of the three-piece Child Resistant Double Seam Container Lid 10C illustrating a conventional lid portion top first piece 12 with an internal locking inner protrusion 16, the adapter ring can locking member second piece 20 with an external locking trough 18 for accepting the locking nib 24 and having a different configuration of the retaining teeth 36 and the securing unit third piece 38, in accordance with the present invention. Again, here the retaining teeth are curved, thinner and more flexible.

Figure 12:
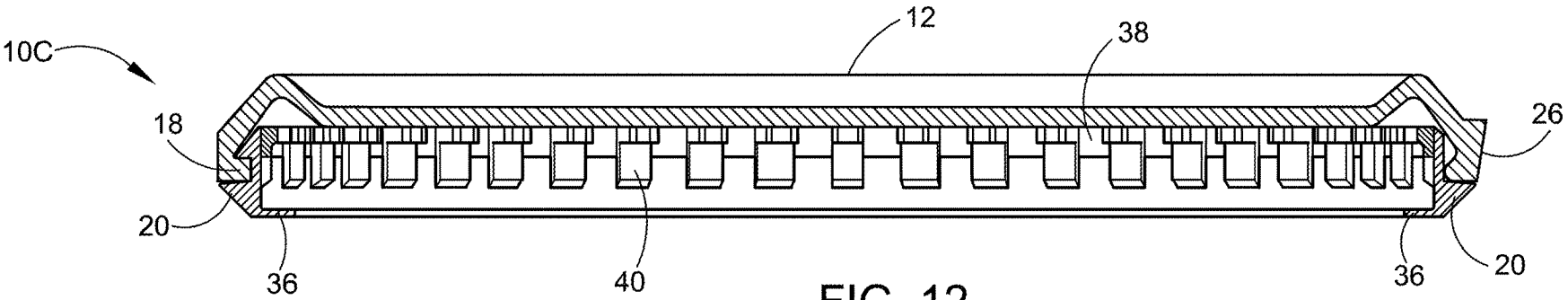
FIG. 12 is a cross-section of the assembled alternate embodiment of the Child Resistant Double Seam Container Lid illustrating a lid portion top piece, and the adapter ring can locking member second piece with the segments of the retaining teeth flat, prior to being bent up when inserted over a conventional can double seam top rim, in accordance with the present invention.

FIG. 12 is a cross-section of the assembled alternate embodiment of the three-piece Child Resistant Double Seam Container Lid 10C illustrating a lid portion top first piece 12, and the adapter ring can locking member second piece 20 with the segments of the thinner flexible retaining teeth 36 flat, prior to being bent up when inserted over a conventional can double seam top rim, and the securing unit third piece 38 having a plurality of retaining teeth 40, in accordance with the present invention.

Figure 13:
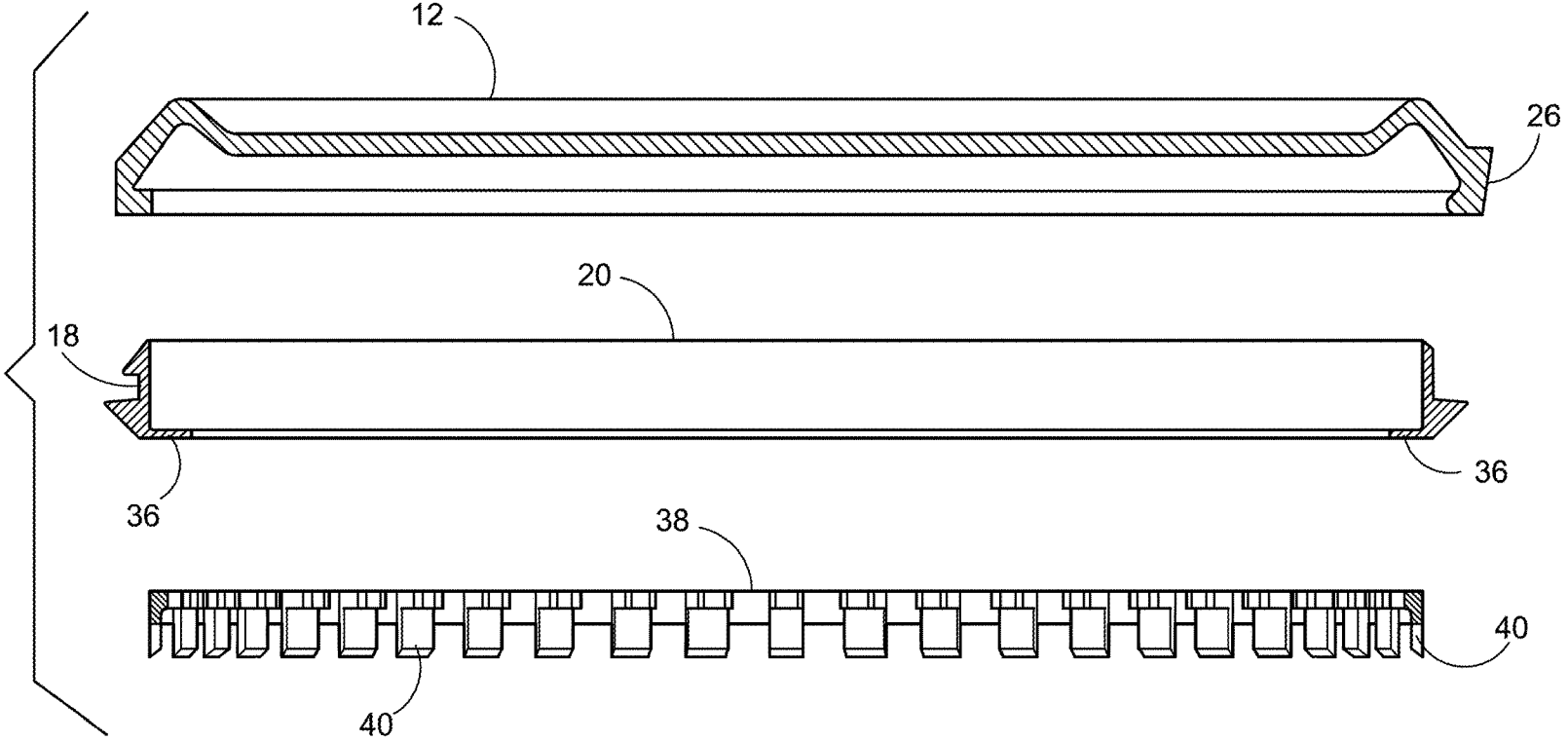
FIG. 13 depicts separate cross-sections views of an alternate embodiment of the Child Resistant Double Seam Container Lid illustrating the lid portion top piece, the adapter ring can locking member second piece and the securing unit third piece, in accordance with the present invention.

FIG. 13 depicts an exploded separate piece cross-sectional views of an alternate embodiment of the three-piece Child Resistant Double Seam Container Lid 10C illustrating the lid portion top first piece 12 and the lid portion rotational alignment indicator section 26, the adapter ring can locking member second piece 20 with the thinner flexible retaining teeth 36 flat, prior to being bent up when inserted over a conventional can double seam top rim and the securing unit third piece 38 with a plurality of retaining teeth 40, in accordance with the present invention.

Figure 14:
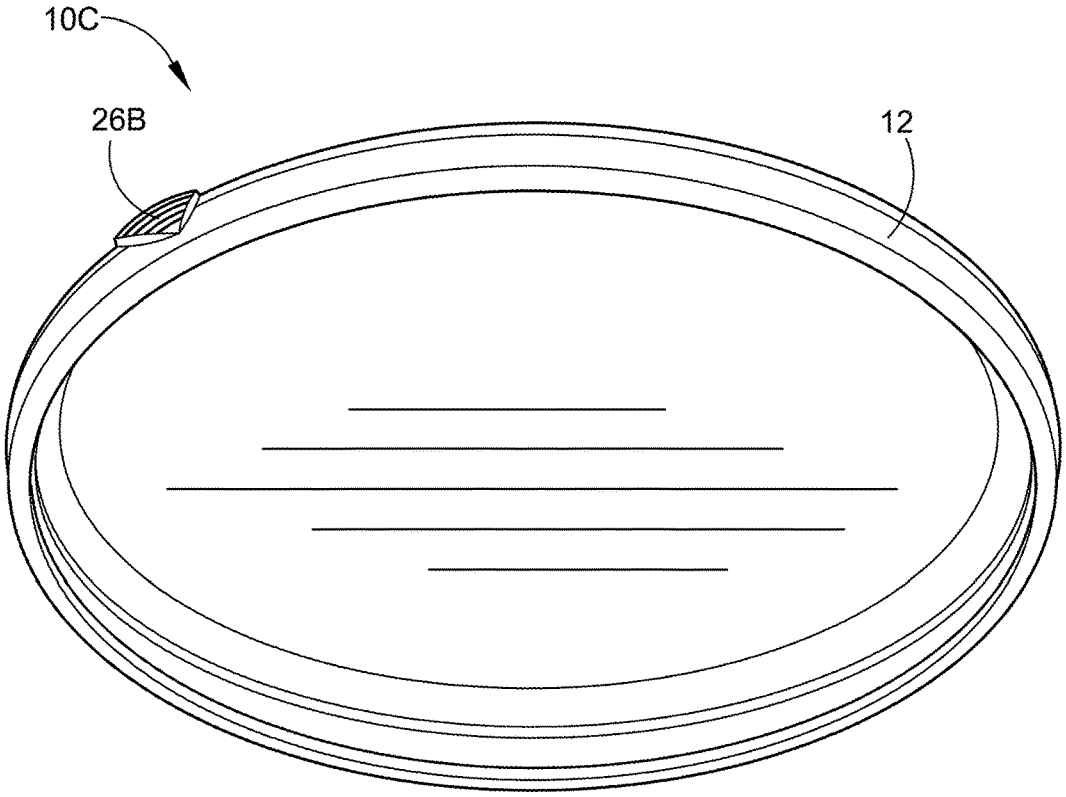
FIG. 14 depicts a perspective bottom view of the lid portion top first piece removed from the adapter ring can locking member second piece as shown in FIG. 15, in accordance with the present invention.
Figure 15:
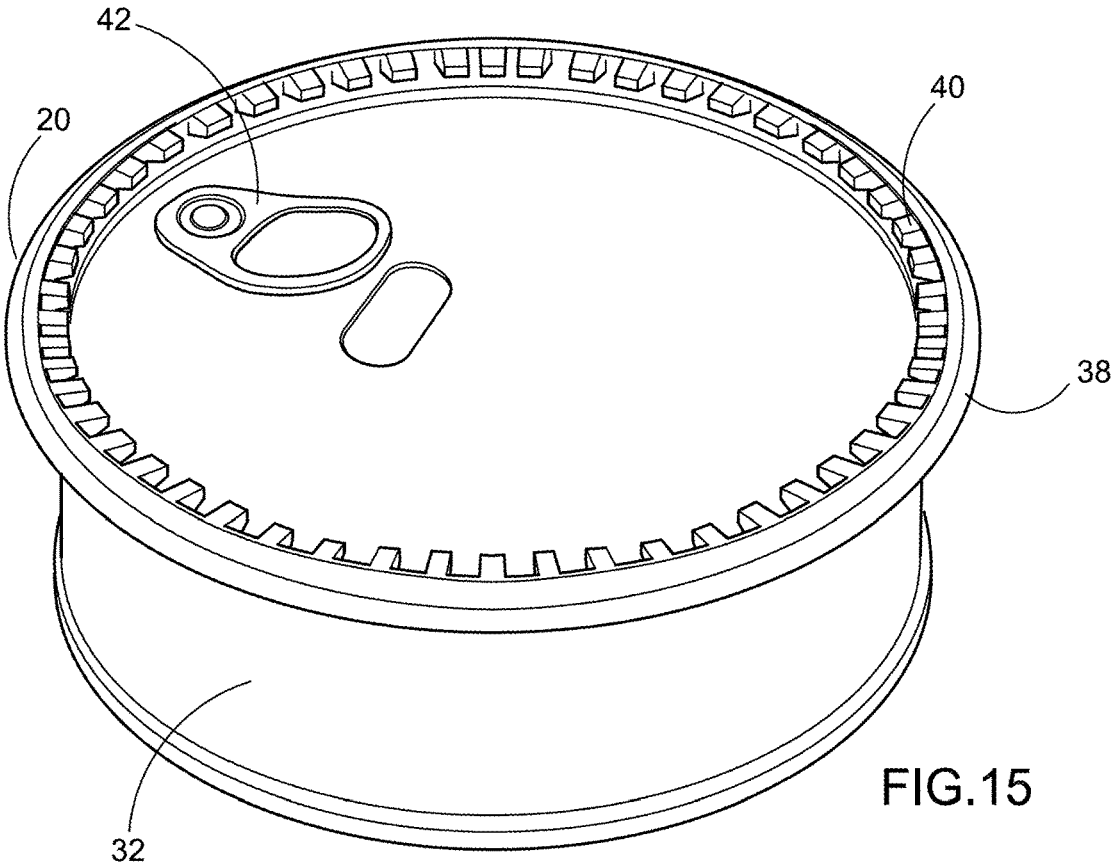
FIG. 15 depicts a perspective top and side elevation view of a pop-top opener removable conventional can top illustrating the Child Resistant Double Seam Container Lid adapter ring can locking member piece and the securing unit piece in place secured on the double seam, in accordance with the present invention.

FIG. 14 depicts a perspective bottom view of the lid portion top first piece 12 alone removed from the adapter ring can locking member second piece 20, as shown in FIG. 15 below, illustrating the rotational indicator section 26 of the alternate embodiment of the three-piece Child Resistant Double Seam Container Lid 10C.

FIG. 15 depicts a perspective top and side elevation view of a pop-top opener 42 removable conventional can 32 top surface, illustrating the Child Resistant Double Seam Container Lid 10C adapter ring can locking member piece 20 with a plurality of retaining teeth (not shown) and the securing unit third piece 38 in place secured on the double seam with a plurality of retaining teeth 40.

Figure 16:
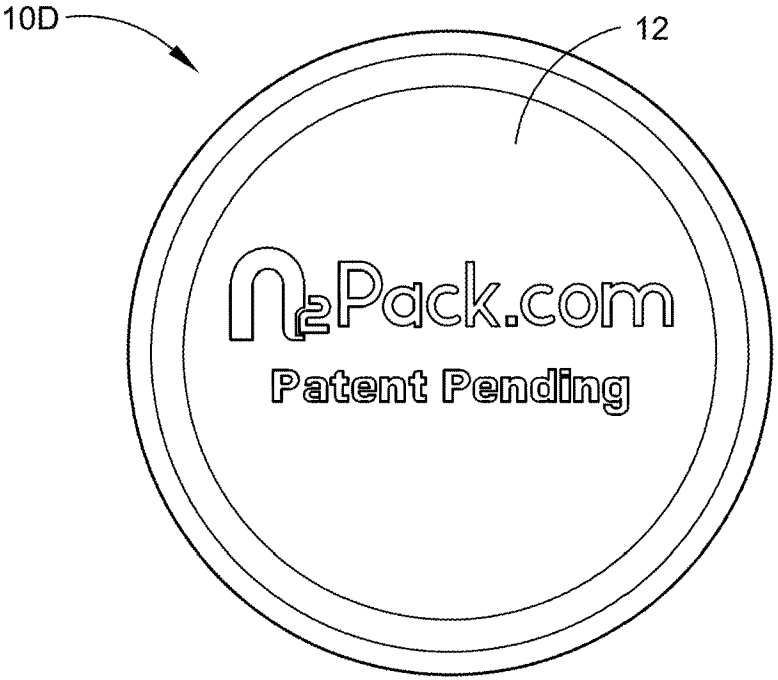
FIG. 16 depicts a top view of an alternate embodiment Child Resistant Double Seam Container Lid having a flexible lid portion top piece including a tab for leveraging open the flexible lid portion top piece, in accordance with the present invention.

FIG. 16 depicts a top view of another alternate embodiment of a one-piece Child Resistant Double Seam Container Lid 10D having a flexible lid portion top piece 12 only, including a protruding leverage tab (not shown, see FIG. 17, FIG. 18 and FIG. 19) for leveraging open the flexible lid portion top piece, making it easier to open.

Figure 17:
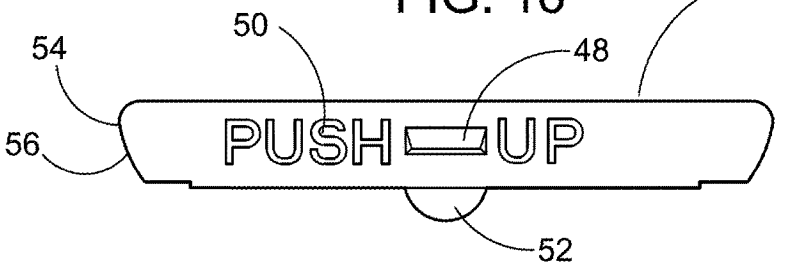
FIG. 17 depicts a side elevation view of the alternate embodiment Child Resistant Double Seam Container Lid shown in FIG. 16, having a flexible lid with the PUSH UP indicia and a lifting leverage tab, in accordance with the present invention.

FIG. 17 depicts a side elevation view of the alternate embodiment one-piece Child Resistant Double Seam Container Lid 10D shown in FIG. 16, having a flexible malleable lid 12 with a lift up protrusion 48, a "PUSH UP" indicia 50 and a lifting leverage tab 52 to assist in the removal of the lid 12. The outer perimeter 54 has a smooth angled surface 56 making it difficult to grip by children.

Figure 18:
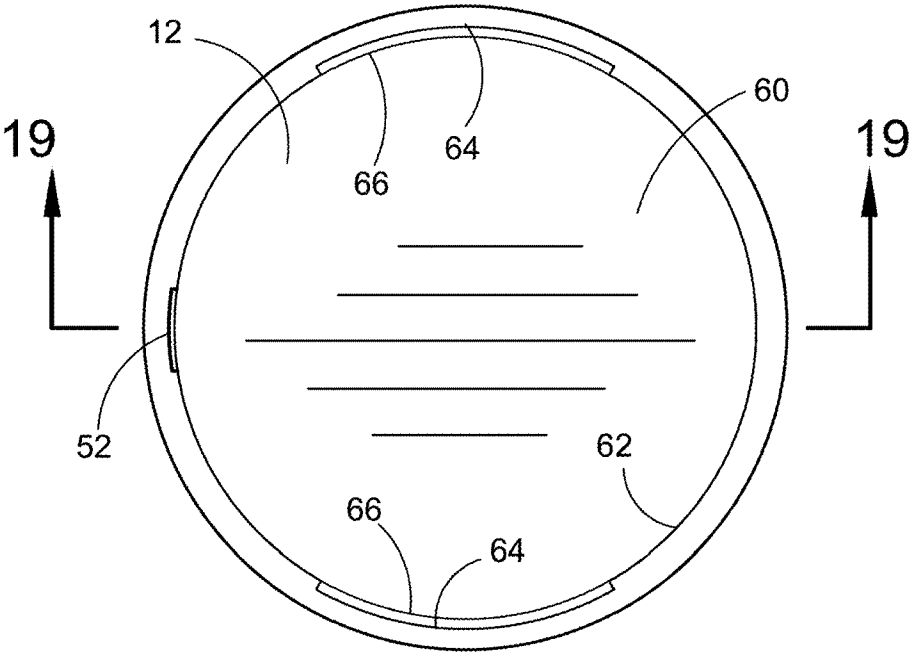
FIG. 18 depicts a bottom view of the alternate embodiment Child Resistant Double Seam Container Lid shown in FIG. 16, having a flexible lid with a lifting leverage tab, in accordance with the present invention.

FIG. 18 depicts a bottom view of the alternate embodiment one-piece Child Resistant Double Seam Container Lid 10D shown in FIG. 17, having a flexible lid 12 with a lifting leverage tab 52. The inner edge surface 62 that is relieved 64 on two areas leaving a ridge 66 to the lid sealing ledge 62 maintain the sealing capability when the Child Resistant Double Seam Container Lid 10D is placed or replaced on a conventional can 32.

Figure 19:
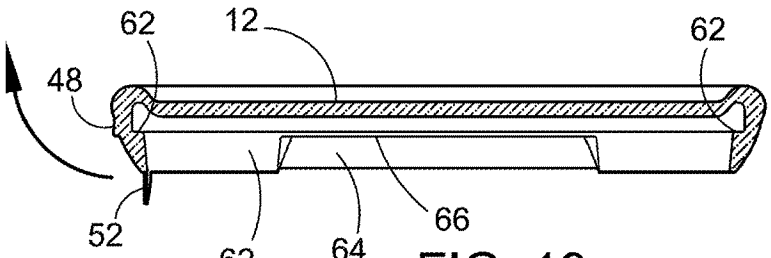
FIG. 19 depicts a cross-section of the alternate embodiment Child Resistant Double Seam Container Lid shown in FIG. 18, having a flexible lid with a lifting leverage tab, in accordance with the present invention.

FIG. 19 depicts a cross-section of the alternate embodiment Child Resistant Double Seam Container Lid 10D as shown in FIG. 18, having a flexible lid portion 12 with a lifting leverage tab 52 further illustrating the tab 52 location, and the inner edge surface 62 is relieved areas 64 on two areas leaving a lid sealing ledge 66. The Child Resistant Double Seam Container Lid flexible lid portion 12 can be rotated upward for removal by stretching the material in the relieved areas 64.

Figure 20:
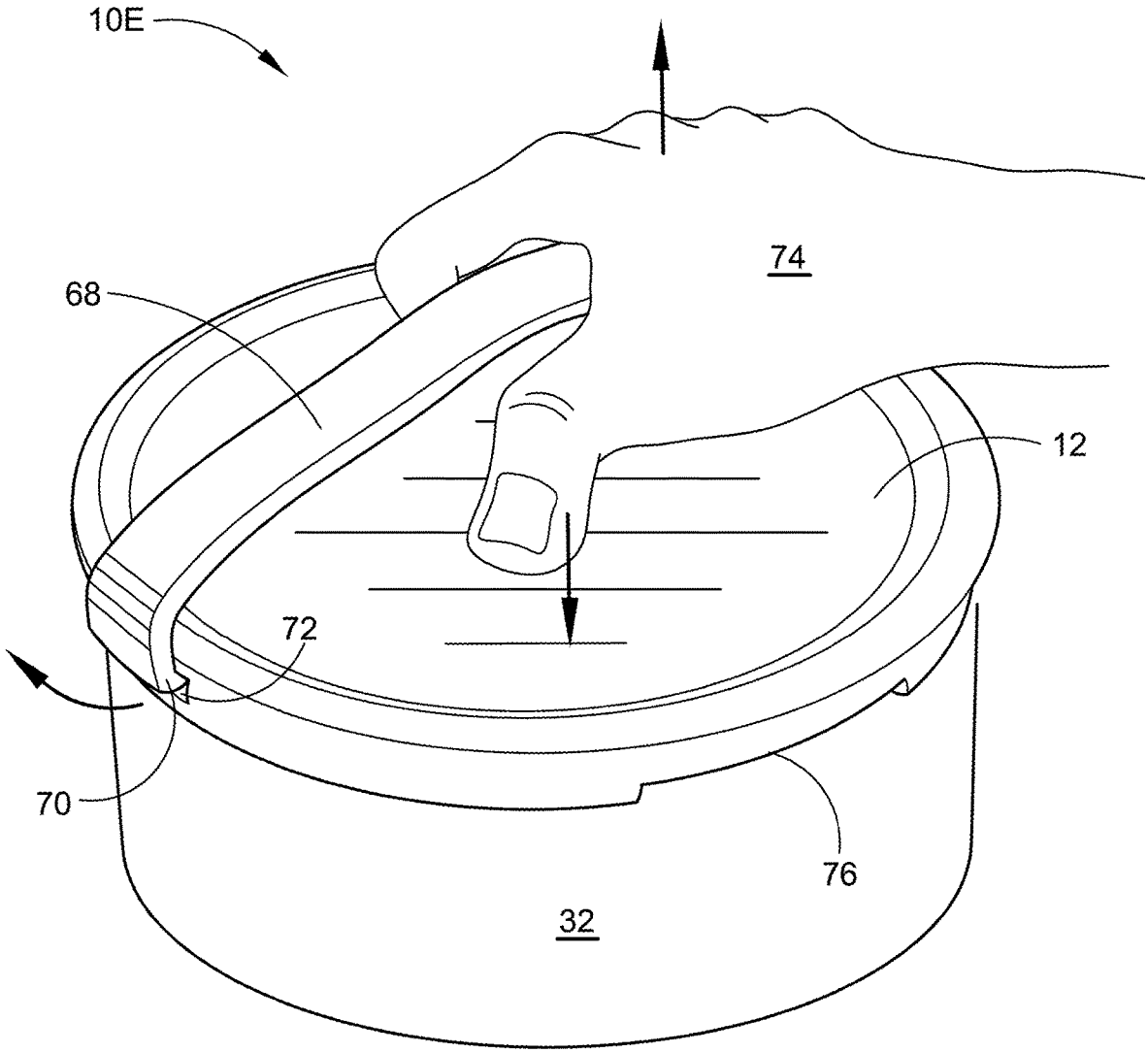
FIG. 20 depicts a perspective view of an alternate embodiment Child Resistant Double Seam Container Lid having a flexible one-piece lid portion piece illustrating a hand with a strap tool exerting pressure to manually bend the lid portion piece to open a container, in accordance with the present invention.

FIG. 20 depicts a perspective view of an alternate embodiment one-piece Child Resistant Double Seam Container Lid 10E having a flexible one-piece lid portion piece 12 illustrating a user's hand 74 with a manual strap tool 68 with end 70 fitted into a slot 70 on the lid 12 exerting pressure to manually bend the lid portion piece 12 to open a container 32. In this regard, a person's hand 74 uses a specialized manual tool 68 for exerting pressure to manually bend the lid 12 at a relieved area 76 to readily open the lid portion 12 on the can 32.

Figure 21:
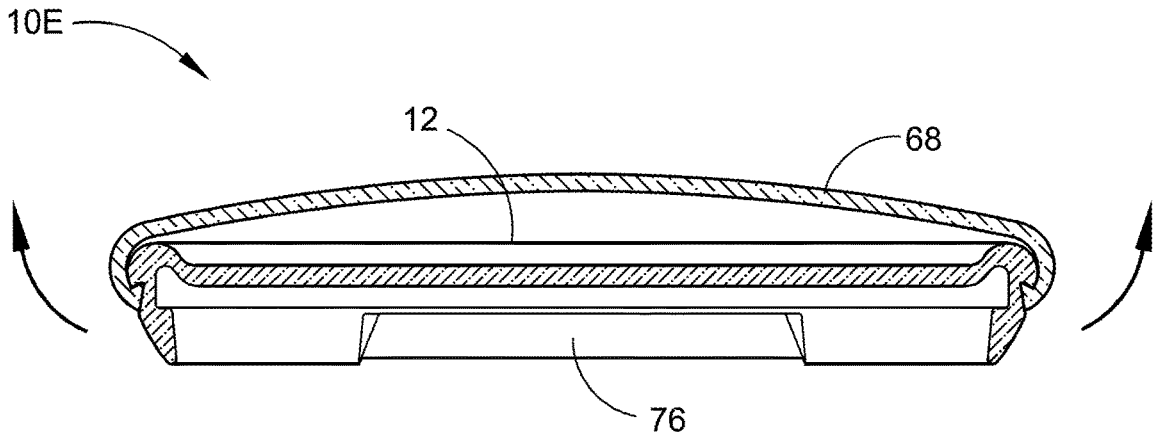
FIG. 21 depicts a cross-section of the Child Resistant Double Seam Container Lid having a flexible one-piece lid portion piece shown in FIG. 20, with the opening tool in place on the lid portion piece, in accordance with the present invention.

FIG. 21 depicts a cross-section of the Child Resistant Double Seam Container Lid 10E having a flexible one-piece lid portion piece 12 as shown in FIG. 20, with the opening tool 68 in place on the lid portion piece 12, showing where pressure can be exerted to bend the lid 12 at the relieved area 76 to open the conventional can 32.

Figure 22:
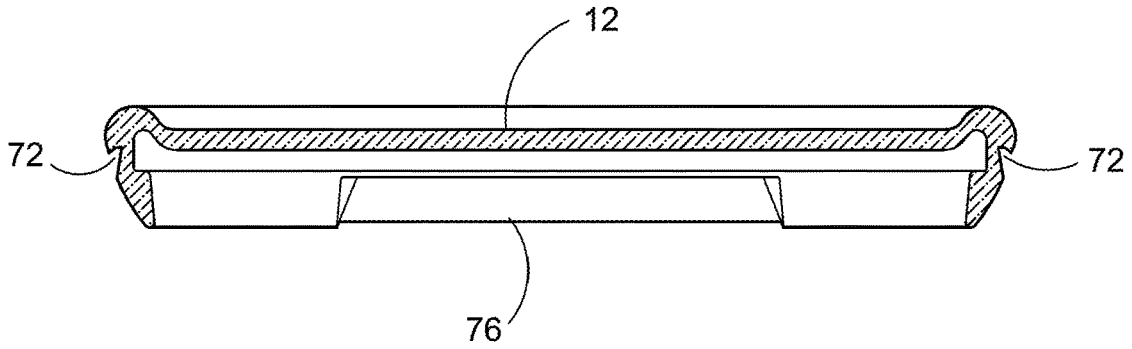
FIG. 22 depicts a cross-section of the Child Resistant Double Seam Container Lid having a flexible one-piece lid portion piece with a thin section therein to aide in the flexibility of the lid, in accordance with the present invention.

FIG. 22 depicts a cross-section of the Child Resistant Double Seam Container Lid 10E having a flexible one-piece lid portion piece 12, further illustrating the location of the thin section slots 72 and the relieved area 76 therein to aide in the flexibility of the lid 12.

Figure 23:
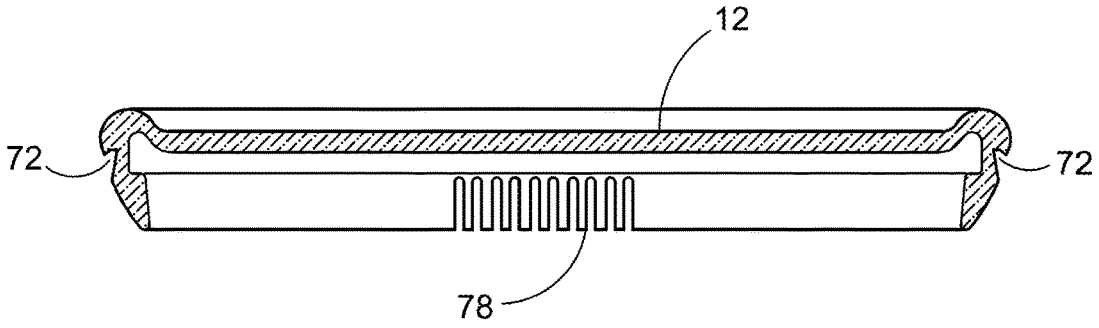
FIG. 23 depicts a cross-section of the Child Resistant Double Seam Container Lid having a flexible one-piece lid portion piece with a slotted section to aid in the flexibility of the lid, in accordance with the present invention.

FIG. 23 depicts a cross-section of the Child Resistant Double Seam Container Lid 10E having a flexible one-piece lid portion piece 12 with a slotted section having a plurality of slots 78 one hundred and eighty degrees apart in the relieved area 76 of the lid so it will flex upward to release from the conventional can 32 when pressure is applied, to aid in the flexibility of the lid.

Figure 24:
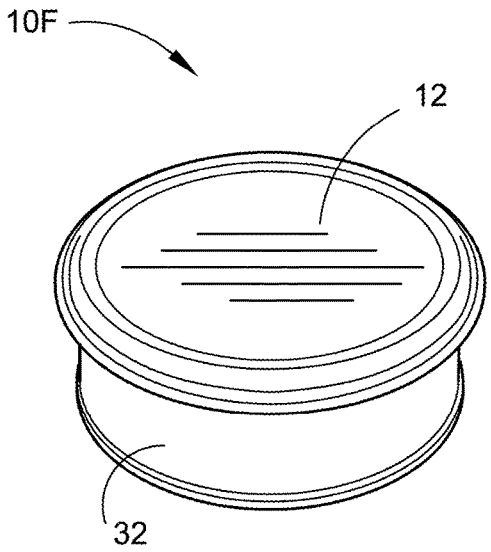
FIG. 24 depicts a top perspective view of another alternate embodiment of the Child Resistant Double Seam Container Lid having the round lid portion first piece placed on a conventional round can, in accordance with the present invention.

FIG. 24 depicts a top perspective view of another alternate embodiment of the three-piece Child Resistant Double Seam Container Lid 10F having the assembled round lid portion first piece 12 and round adapter ring can locking member second piece in place on a conventional round can 32, in accordance with the present invention.

Figure 25:
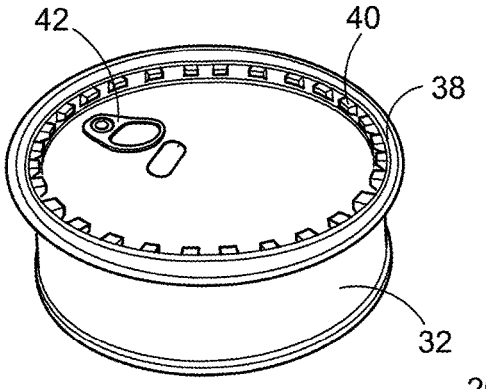
FIG. 25 depicts a top perspective view of the alternate embodiment of the Child Resistant Double Seam Container Lid shown in FIG. 24 illustrating the top of a conventional round can with pop top opener having the adapter ring can locking member in place secured to the double seam of the can, in accordance with the present invention.

FIG. 25 depicts a top perspective view of the alternate embodiment of the three-piece Child Resistant Double Seam Container Lid 10F shown in FIG. 24 illustrating the top of a conventional round can 32 with pop top opener 42 having the adapter ring can locking member second piece 20 and securing member third piece 38 in place secured to the double seam of the conventional can 32. Retaining teeth 40 on the securing member third piece 38 are visible, but the retaining teeth 36 on the adapter ring 20 are not visible in this view.

Figure 26:
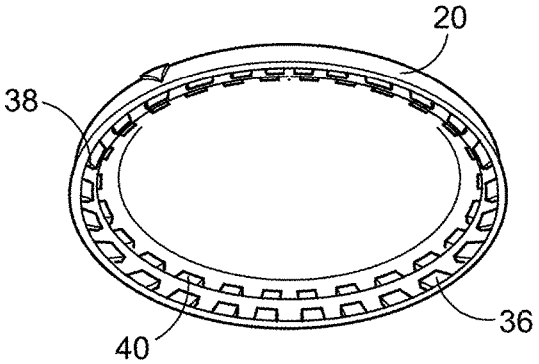
FIG. 26 depicts a bottom perspective view of the alternate embodiment of the Child Resistant Double Seam Container Lid shown in FIG. 25 having the round adapter ring can locking member apart from the conventional can double seam, illustrating the retaining teeth along the circumference of the round adapter ring, in accordance with the present invention.

FIG. 26 depicts a bottom perspective view of the alternate embodiment of the three-piece Child Resistant Double Seam Container Lid 10F shown in FIG. 25 having the assembled round adapter ring can locking member 20 and securing unit 38 apart from the conventional can double seam, illustrating the retaining teeth 36 along the circumference of the round adapter ring 20 and the retaining teeth 40 along the circumference of the securing unit 38.

Figure 27:
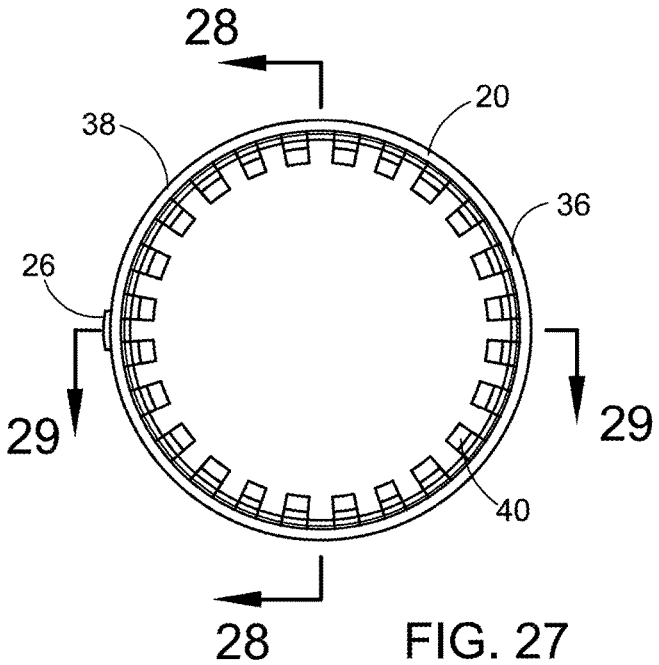
FIG. 27 depicts a bottom view of the alternate embodiment of the Child Resistant Double Seam Container Lid shown in FIG. 26 illustrating the pattern of a plurality of retaining teeth, in accordance with the present invention.

FIG. 27 depicts a bottom view of the alternate embodiment of the three-piece Child Resistant Double Seam Container Lid 10F shown in FIG. 26 illustrating the pattern of a plurality of retaining teeth 36 on the adapter ring can locking member 20 and the retaining teeth 40 on the securing unit 38.

Figure 28:
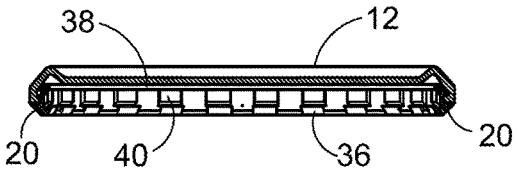
FIG. 28 depicts a cross-section of the assembled alternate embodiment of the Child Resistant Double Seam Container Lid shown in FIG. 24, in accordance with the present invention.

FIG. 28 depicts a cross-section of the assembled alternate embodiment of the three-piece Child Resistant Double Seam Container Lid 10F shown in FIG. 27, illustrating here the assembled three pieces of the child resistant lid configuration, namely, the lid portion first piece 12 on the adapter ring can locking member second piece 20, and the securing unit third piece 38. This view also shows the retaining teeth 36 on the adapter ring 20 and the retaining teeth 40 on the securing unit 38.

Figure 29:
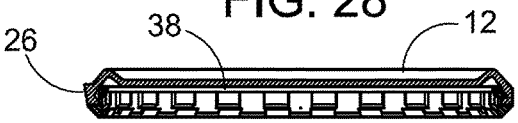
FIG. 29 depicts a cross section of the assembled alternate embodiment of the Child Resistant Double Seam Container Lid shown in FIG. 24 illustrating the location of the indicator section on the left side, in accordance with the present invention.

FIG. 29 depicts another cross-section of the assembled alternate embodiment of the three-piece Child Resistant Double Seam Container Lid 10F shown in FIG. 27 illustrating the location of the rotational alignment indicator section 26 on the left side of the lid portion first piece 12.

Figure 30:
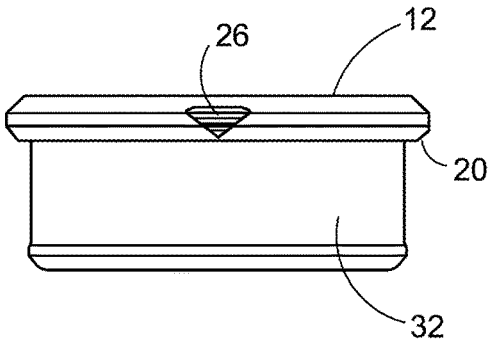
FIG. 30 depicts a side view of a conventional can incorporating the assembled alternate embodiment of the Child Resistant Double Seam Container Lid shown in FIG. 24 illustrating the indicator sections aligned for opening or closing the lip portion piece, in accordance with the present invention.

FIG. 30 depicts a side view of a conventional can incorporating the assembled alternate embodiment of the three-piece Child Resistant Double Seam Container Lid 10F shown in FIG. 24 illustrating the rotational alignment indicator sections 26 aligned for opening or closing the lip portion piece 12, in accordance with the present invention.

Figure 31:
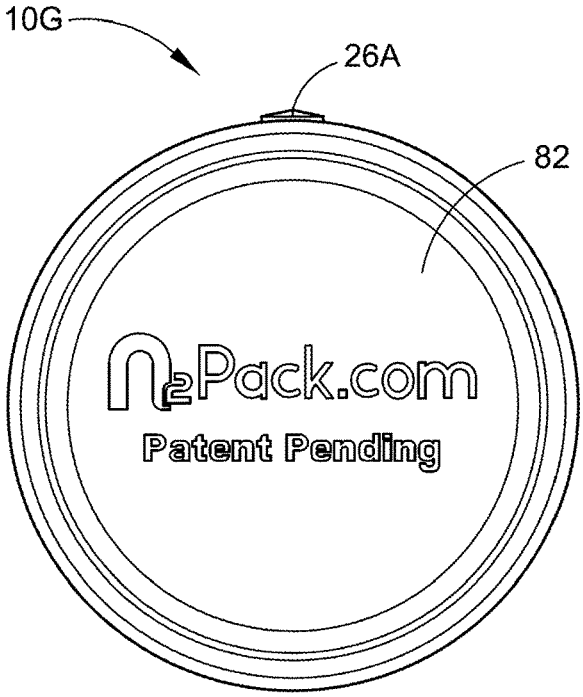
FIG. 31 depicts a top view of an alternate embodiment of the Child Resistant Double Seam Container Lid, in accordance with the present invention.

FIG. 31 depicts a top view of an alternate embodiment of a two-piece Child Resistant Double Seam Container Lid 10G having a liquid tight vacuum sealing lid 82 showing the rotational alignment indicator 26A on the lid portion first piece 82.

Figure 32:
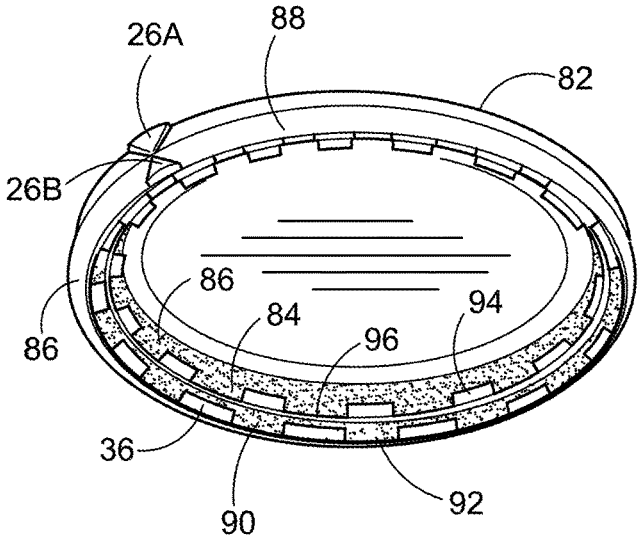
FIG. 32 depicts a bottom perspective view of the underside of an assembled alternate embodiment of the Child Resistant Double Seam Container Lid illustrating the connected lid portion top piece and the adapter ring can locking member piece having a vacuum sealing gasket feature, in accordance with the present invention.

FIG. 32 depicts a bottom perspective view of the underside of an assembled alternate embodiment of the two-piece Child Resistant Double Seam Container Lid 10G illustrating the connected lid portion top piece 82 with the rubber sealant coating 84 applied to the lid inner surface 86, with the vacuum sealing adapter ring can locking member 88 having the rubber sealant 90 applied on the inner surface of the edge 92. The inner surface of the vacuum sealing can locking member 88 has a plurality of retaining teeth 36 on the lower edge 92 and a plurality of upper supporting teeth 94 on the upper edge 96. Together, rubber sealing coating 84 on lid portion 82 and the rubber sealing coating 90 on adapter ring 88 make the overall lid 82 liquid tight and capable of being vacuum sealed. Also shown is the rotational alignment indicators 26A on lid portion 82 and 26B on the adapter ring 88, here being in alignment for opening and removing the lid 82 up and off of the adapter ring 88.

Figure 33:
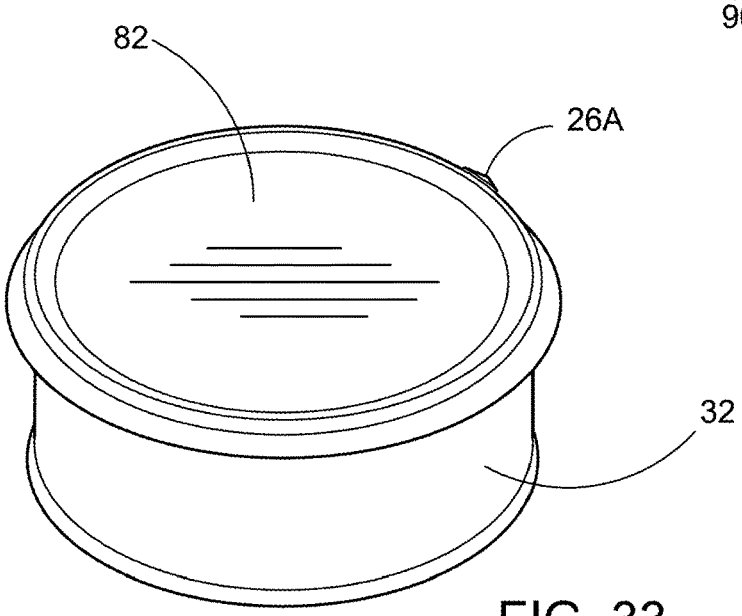
FIG. 33 depicts a top perspective view of the top surface of the alternate embodiment of the Child Resistant Double Seam Container Lid shown in FIG. 32 in place on a conventional round can, in accordance with the present invention.

FIG. 33 depicts a top perspective view of the top surface of the alternate embodiment of the two-piece Child Resistant Double Seam Container Lid 10G shown in FIG. 32 in place on a conventional round conventional can 32, and showing the lid rotational indicator 26A.

Figure 34:
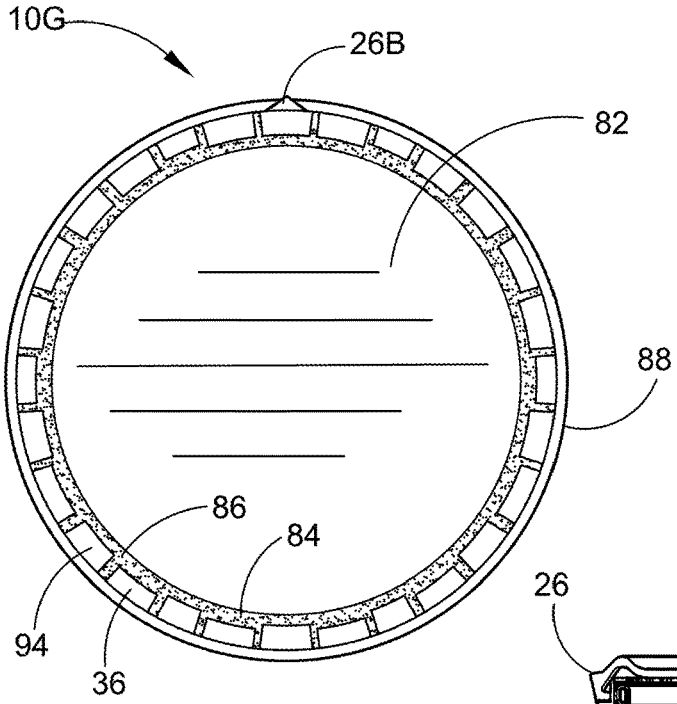
FIG. 34 depicts a bottom view of the underside of an alternate embodiment of the Child Resistant Double Seam Container Lid with a vacuum sealing can lid configuration incorporating the vacuum sealing lid portion top piece and the adapter ring can locking member piece, in accordance with the present invention.

FIG. 34 depicts a bottom view of the underside of an alternate embodiment of the two-piece Child Resistant Double Seam Container Lid 10G with a vacuum sealing can lid 82 configuration incorporating the vacuum sealing lid portion top piece 82 and the adapter ring can locking member piece 88 showing the location of retaining teeth 36 around the circumference of the adapter ring 88. Also seen here is the rubber sealing coating 84 located on the lid inner surface 86 and a plurality of upper supporting teeth 94.

Figure 35:
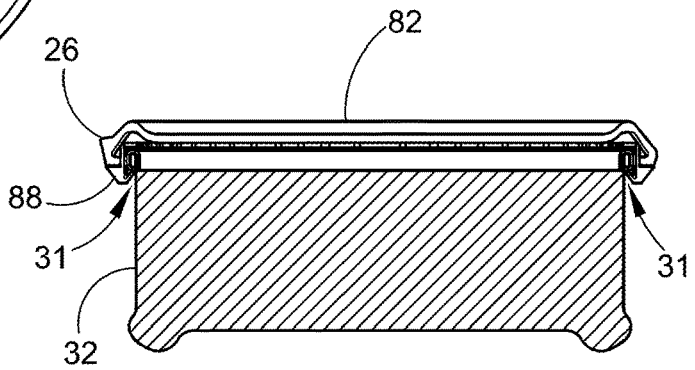
FIG. 35 depicts a cross-section of the alternate embodiment of the Child Resistant Double Seam Container Lid shown in FIG. 34 in place on a conventional round can secured to the double seam with the vacuum sealing lid portion piece and incorporating the vacuum sealing adapter ring can locking member piece, in accordance with the present invention.

FIG. 35 depicts a cross-section of the alternate embodiment of the two-piece Child Resistant Double Seam Container Lid 10G shown in FIG. 34 in place on a conventional round can 32 secured to the double seam 31 with the vacuum sealing lid portion piece 82 and incorporating the vacuum sealing adapter ring can locking member piece 88.

Figure 36:
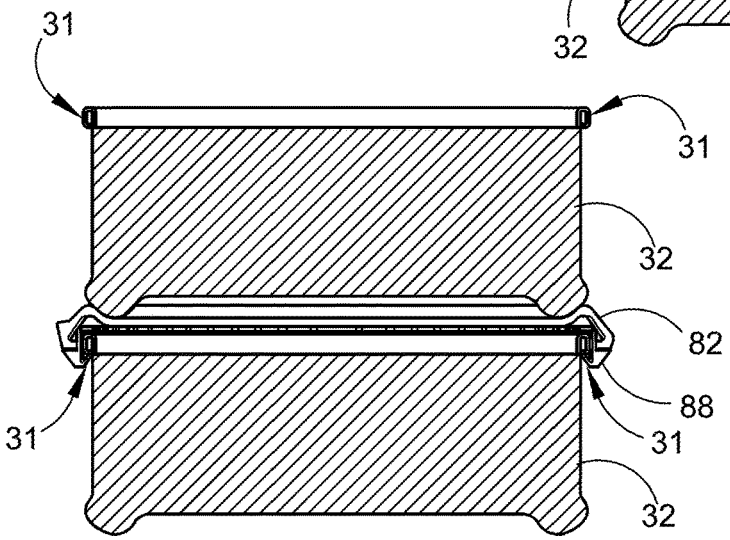
FIG. 36 depicts a cross-section of two conventional round cans with the alternate embodiment of the Child Resistant Double Seam Container Lid shown in FIG. 35 in place on the lower can secured to the double seam, illustrating the contoured surface of the lid portion top piece for facilitating stacking of the cans so equipped, in accordance with the present invention.

FIG. 36 depicts a cross-section of two conventional round stacked cans 32 with the alternate embodiment of the two-piece Child Resistant Double Seam Container Lid 10G shown in FIG. 35 in place on the lower can 32 with the adapter ring 88 secured to the double seam 31, illustrating the contoured surface of the lid portion top piece 82 configured specifically for facilitating stacking of the cans so equipped.

Figure 37:
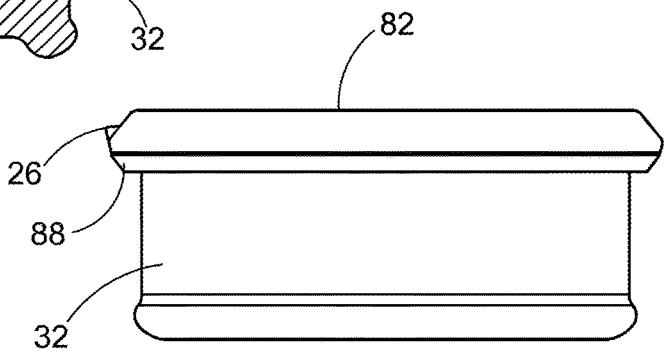
FIG. 37 depicts a side elevation view of the alternate embodiment of the Child Resistant Double Seam Container Lid shown in FIG. 35 in place on a conventional round can double seam, in accordance with the present invention.

FIG. 37 depicts a side elevation view of the alternate embodiment of the assembled two-piece Child Resistant Double Seam Container Lid 10G shown in FIG. 35 in place on a conventional round can 32 double seam, and showing the location of the rotational alignment indicator section 26.

Figure 38:
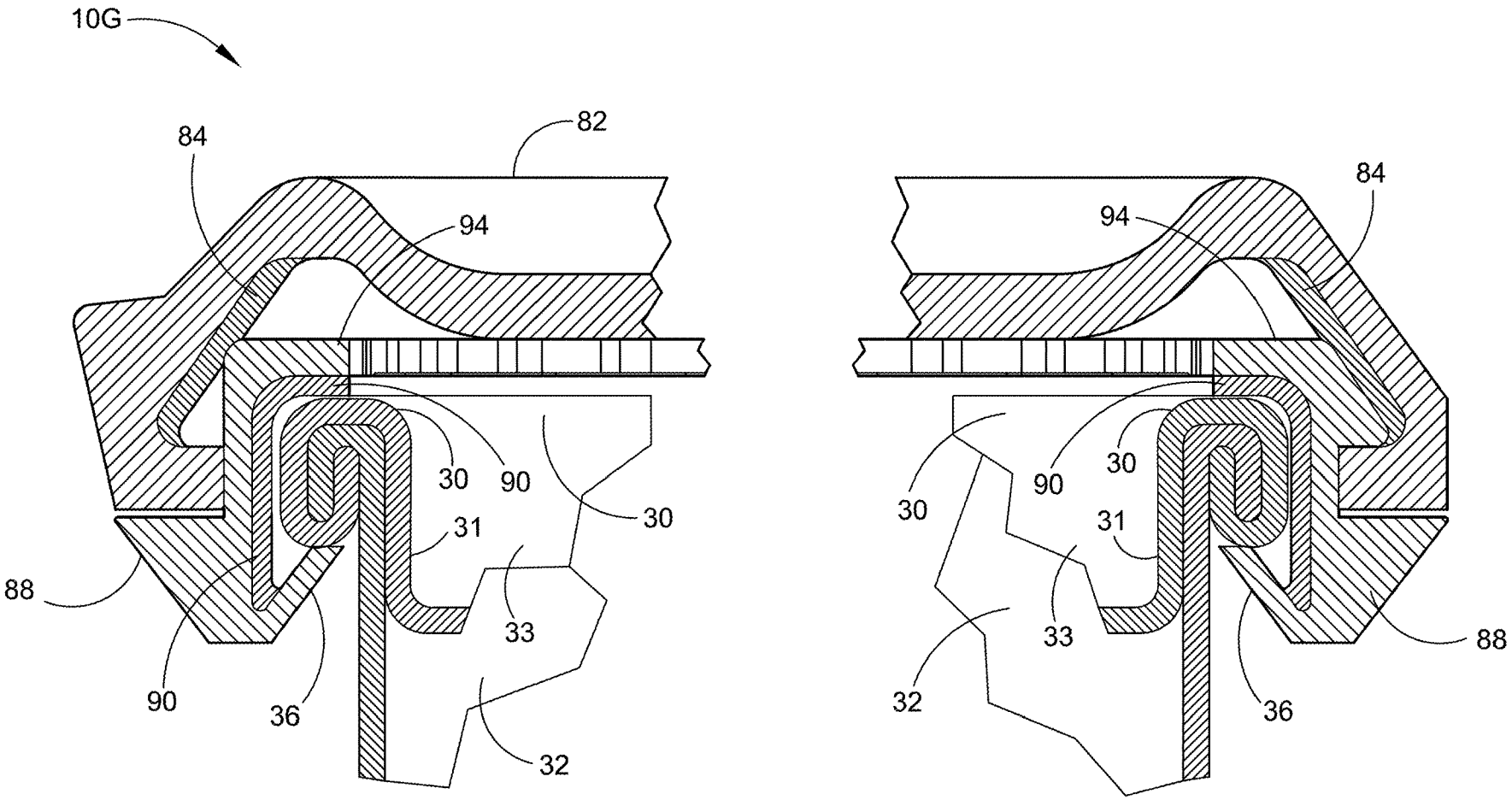
FIG. 38 depicts an enlarged cross-section of the alternate embodiment of the Child Resistant Double Seam Container Lid shown in FIG. 35 in place on a conventional round can double seam illustrating the vacuum sealing lid having an adapter ring can locking member with a rubber seal coating and lid portion top piece having a rubber sealing coating, in accordance with the present invention.

FIG. 38 depicts an enlarged partial cross-section of the alternate embodiment of the two-piece Child Resistant Double Seam Container Lid 10G shown in FIG. 35 in place on a conventional round can 32 double seam 31 illustrating the vacuum sealing lid portion 82 having an adapter ring can locking member 88 with a rubber seal coating 90 and lid portion top piece 82 having a rubber sealing coating 84. When cans are double seamed, the lid 30 and the can wall 32 are folded to create a closed double seam 31 having five layers. All of the adapter rings as disclosed herein are configured to be secured to this double seam. The adapter ring 88 snaps on to the double seam 31 and is secured by upper retaining teeth 94 and retaining teeth 36. Together, rubber sealing coating 84 on lid portion 82 and the rubber sealing coating 90 on adapter ring 88 make the overall assembled lid 82 and adapter ring 88 liquid tight and capable of being vacuum sealed.

Figure 39:
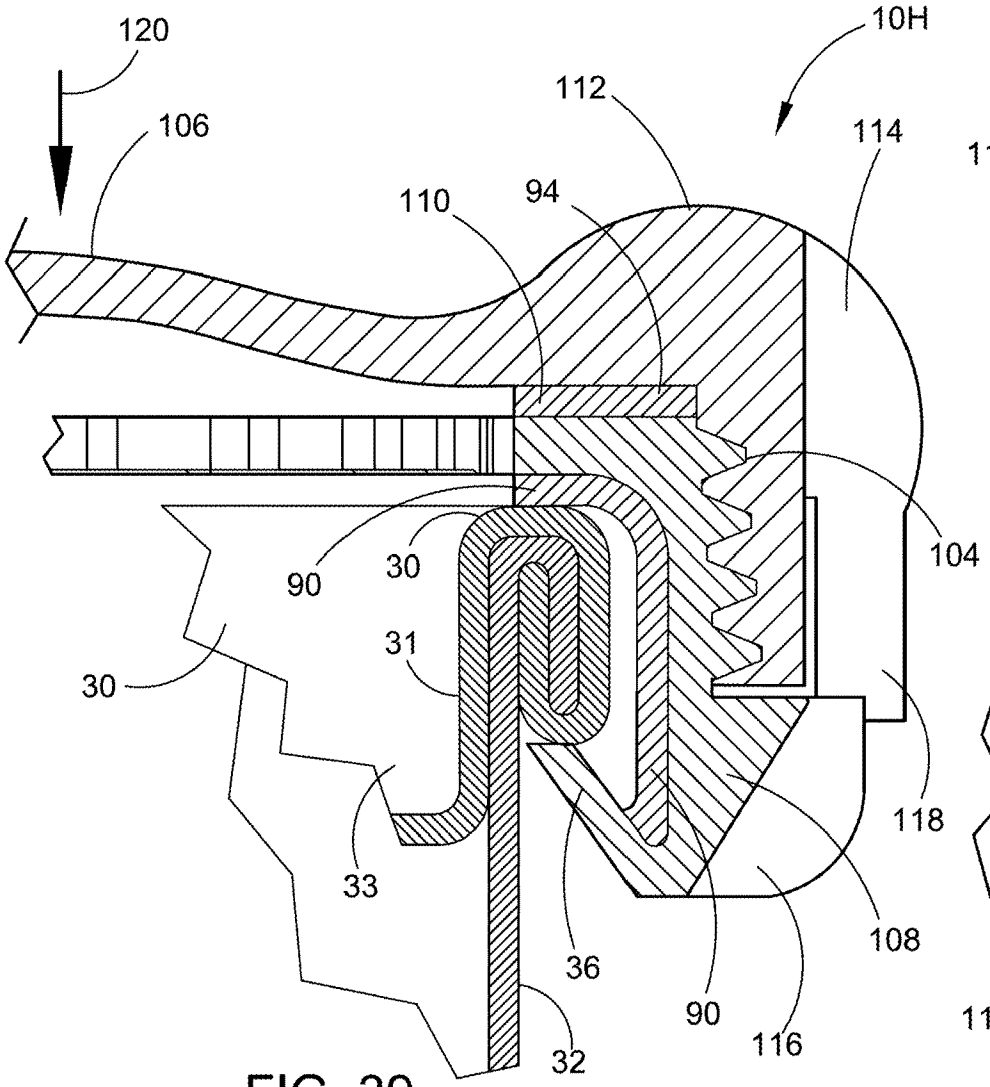
FIG. 39 depicts an enlarged cross-section of another alternate embodiment of the Child Resistant Double Seam Container Lid incorporating a vacuum sealing threaded lid portion top piece attached to a vacuum sealing threaded adapter ring can locking member piece, in accordance with the present invention.

FIG. 39 depicts an enlarged cross-section of another alternate embodiment of the two-piece Child Resistant Double Seam Container Lid 1011 incorporating a vacuum sealing threaded lid portion top piece 112 having threads 104 attached to a vacuum sealing threaded adapter ring can locking member piece 108 including mating threads to lid threads 104. The vacuum sealing can locking member 108 puts pressure on the rubber sealing coating 90 on the side and top of the can rim 30 when the retaining teeth are locked under the can rim 30. When the lid 106 is tightened down it puts pressure on the rubber sealing coating 110 on the lid 106 and the vacuum sealing can locking member 108. The adapter ring 88 snaps on to the double seam 31 and is secured by upper retaining teeth 94 and retaining teeth 36. Together, rubber sealing coating 84 on lid portion 82 and the rubber sealing coating 90 on adapter ring 88 make the overall assembled lid 82 and adapter ring 88 liquid tight and capable of being vacuum sealed. The lid 106 has a bulbous area 112 on the outer edge with a plurality gripping ribs 114 around the perimeter to aide in tightening down the lid 106. A second set of gripping ribs 116 are on the perimeter of the vacuum sealing can locking member 108. A flexible locking tab 118 is located on one of the gripping ribs 114 to engage with one of the gripping ribs 116 that can be bent upward to release the lid 106 to rotate and open the can 32. By pressing 120 down on the lid 106 a partial vacuum will be achieved within the can 32.

Figure 40:
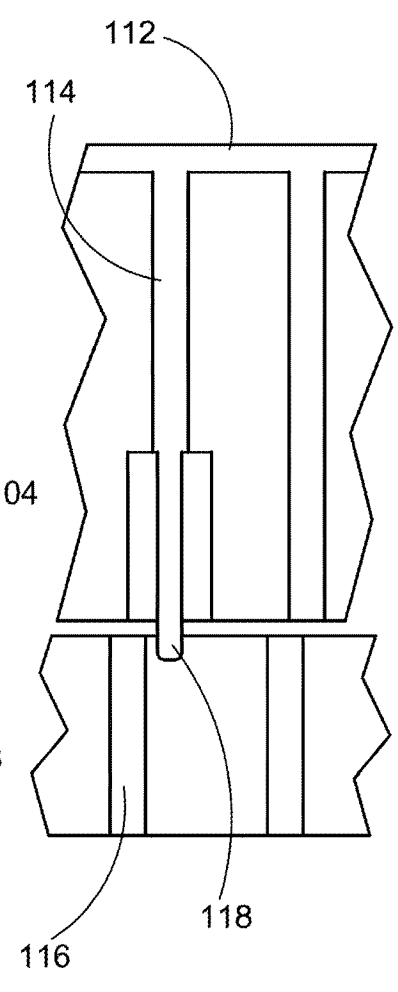
FIG. 40 depicts a partial side view of the alternate embodiment of the Child Resistant Double Seam Container Lid illustrating the vacuum sealing lid portion top piece in the locked position, in accordance with the present invention.

FIG. 40 depicts a partial side view of the alternate embodiment of the two-piece threaded Child Resistant Double Seam Container Lid 1011 illustrating the vacuum sealing lid portion top piece 112 gripping ribs 114 on the lid 106 and the gripping ribs 116 on the vacuum sealing can locking member 108 with the flexible locking tab 118 straight down in the locked position.

Figure 41:
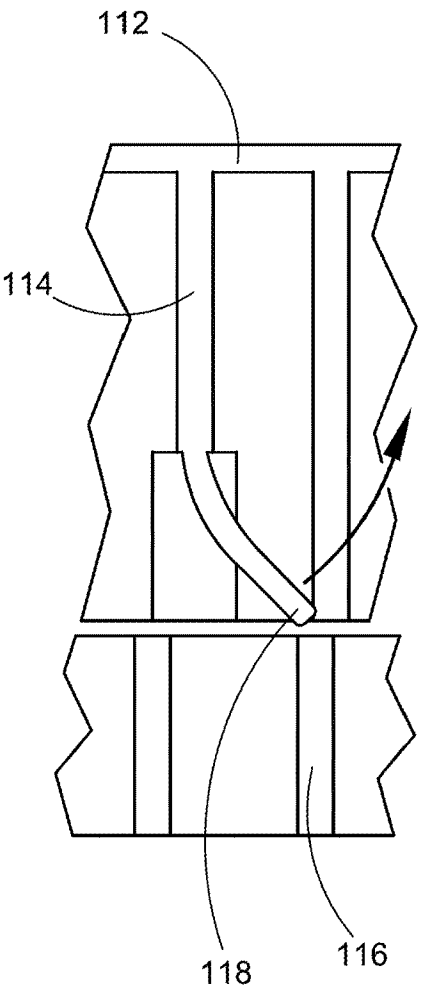
FIG. 41 depicts a partial side view of the alternate embodiment of the Child Resistant Double Seam Container Lid illustrating the vacuum sealing lid portion top piece in the unlocked position, in accordance with the present invention.

FIG. 41 depicts a partial side view of the alternate embodiment of the two-piece threaded Child Resistant Double Seam Container Lid 1011 illustrating the vacuum sealing lid portion top piece 112 in the unlocked position, illustrating detail of the gripping ribs 114 on the lid 106 and the gripping ribs 116 on the vacuum sealing can locking member 108 with a flexible locking tab 118 straight down in the locked position.

Figures 42, 43, 44, 45:
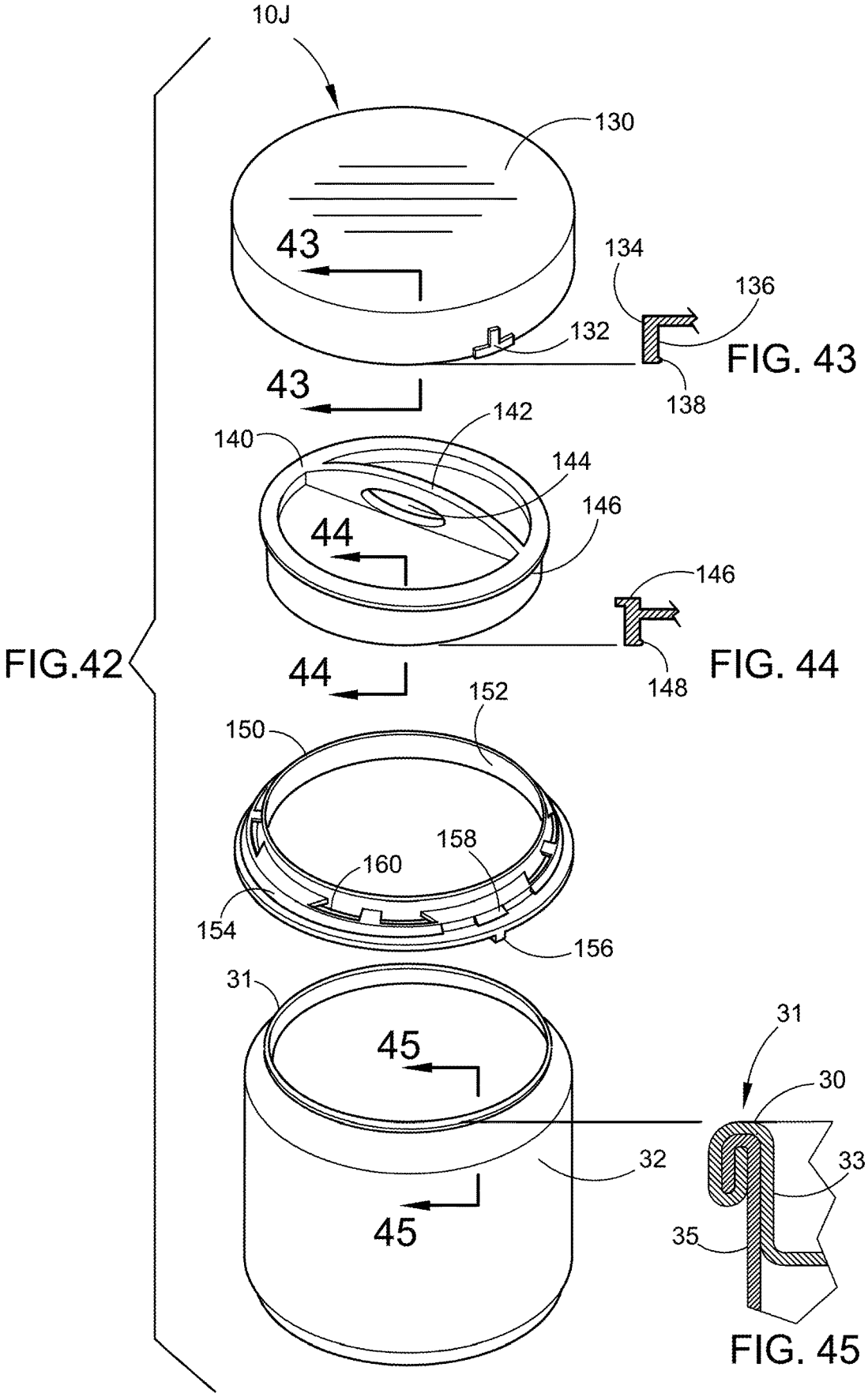
FIG. 42 depicts an exploded top and side perspective view of a three-piece Child Resistant Double Seam Container Lid incorporating a first piece round lid portion top piece, a second piece adapter ring can locking member piece, and a third piece divided measuring cup.
FIG. 43 depicts a partial cross-sectional view of the lid portion top piece of the three-piece Child Resistant Double Seam Container Lid incorporating a divided measuring cup shown in FIG. 42.
FIG. 44 depicts a cross-sectional view of the middle piece measuring cup portion of the three-piece Child Resistant Double Seam Container Lid incorporating a divided measuring cup shown in FIG. 42.
FIG. 45 depicts an enlarged cross-sectional view of the double seam on a can rim top portion of the container which accepts the second piece round adapter ring can locking member piece of the three-piece Child Resistant Double Seam Container Lid incorporating a divided measuring cup shown in FIG. 42.

FIG. 42 depicts an exploded top and side perspective view of a two-piece Child Resistant Double Seam Container Lid 10J incorporating a measuring cup, having a first round lid portion top piece 130, a second adapter ring can locking member piece 150, configured to accommodate a divided measuring cup 140. The measuring cup 140 is divided by a handle 142 having an optional orifice 144. A rotational alignment indicator 132 is also shown on the first round lid portion top piece 130. The adapter ring 150 has an inner surface 152 and an outer surface 154 and is configured to accept the measuring cup 140 when nested within the inner surface 152. The adapter ring lower surface 154 includes locking slots 158 and locking ring lid locking tab accepting openings 160 (see FIGS. 46-51), and is configured to be securely affixed to the double seam 31 of a conventional can 32 (for detail of the double seam structure see FIG. 45). A rotational alignment indicator 156 is also shown on the second adapter ring can locking member piece 150.

FIG. 43 depicts a partial cross-sectional view of the lid portion top piece 130 of the two-piece Child Resistant Double Seam Container Lid 10J incorporating a divided measuring cup shown in FIG. 42. The lid portion top piece 130 has an outer surface 134 and an inner surface 136 with a nib 138 extending around the lower circumference of the inner surface 136.

FIG. 44 depicts a cross-sectional view of the middle piece measuring cup portion 140 of the two-piece Child Resistant Double Seam Container Lid 10J incorporating a divided measuring cup shown in FIG. 42. The measuring cup 140 is divided by a handle 142 having an optional orifice 144 as seen in FIG. 42. The measuring cup 140 also includes a rim 146 and an inner nib 148 extending around the entire circumference of the measuring cup 140 to allow the measuring cup to rest on the adapter ring 150 when nested therein.

FIG. 45 depicts an enlarged cross-sectional view of the double seam 31 on a can rim top portion 30 of the container which accepts the second piece round adapter ring can locking member piece 150 of the two-piece Child Resistant Double Seam Container Lid 10J incorporating a divided measuring cup shown in FIG. 42. The double seam 31 is made up of five layers (three layers of the can lid 33 and two layers of the can wall 35) after the can lid 33 and the can wall 35 are folded into a double seam 31. This forms the can rim top portion 30 for which all adapter rings disclosed herein are configured to be secured to by various means.

FIG. 46 depicts a bottom plan view of the lid portion top piece 130 of the two-piece Child Resistant Double Seam Container Lid 10J incorporating a divided measuring cup shown in FIG. 42. The inner surface of the lid 130 has a plurality of spaced apart lid locking tabs 162. These lid locking tabs 162 are configured to be accepted by the adapter ring locking and unlocking slots 158.

FIG. 47 depicts a top plan view of the adapter ring portion 150 of the two-piece Child Resistant Double Seam Container Lid 10J incorporating a divided measuring cup shown in FIG. 42. The adapter ring locking member 150 has an inner surface 152 and an outer surface 154 as well as a rotational alignment indicator section 156 (not seen here, see FIG. 42). Also seen in this top plan view is a plurality of locking ring locking tab sections 164 and a locking ring locking nib section 166.

FIG. 48 depicts a cross-sectional view of the adapter ring portion 150 of the two-piece Child Resistant Double Seam Container Lid 10J incorporating a divided measuring cup shown in FIG. 47. This cross-section shows the locking/unlocking slot 158 as well as the locking ring lid locking nib section 166.

FIG. 49 depicts another cross-sectional view through a different section of the adapter ring portion 150 of the two-piece Child Resistant Double Seam Container Lid 10J incorporating a divided measuring cup shown in FIG. 47. This cross-section also shows the locking/unlocking slot 158 and the locking ring lid locking nib section 166 as well as a locking ring double seam container locking nib section 168.

FIG. 50 depicts yet another cross-sectional view through yet a different section of the adapter ring portion 150 of the two-piece Child Resistant Double Seam Container Lid 10J incorporating a divided measuring cup shown in FIG. 47, illustrating the position of the locking ring lid locking nib section 166.

FIG. 51 depicts a bottom plan view of the adapter ring portion of the two-piece Child Resistant Double Seam Container Lid 10J incorporating a divided measuring cup shown in FIG. 47. The adapter ring locking member 150 has an inner surface 152 and a rotational alignment indicator section 156. Also seen in this bottom plan view is a plurality of locking ring locking tab sections 164 and a plurality of locking ring locking tab accepting openings 160.

FIG. 52 depicts a top perspective view of three adapter rings 150 connected together by a frangible plastic bridge connection point 170 configured to hold three containers together here, showing one container 30 below the adapter ring 3-pack and not connected thereto by its double seam 31. In this way, it is anticipated that 2-packs, 3-packs, 4-packs, 6-packs, 8-packs, etc. of connected containers can be configured by using the frangible plastic bridge connection 170 between a plurality of adapter rings 150 to form food and beverage packs having containers that are easily separated by pulling the frangible plastic bridge connection 170 apart.

FIG. 53 depicts a top perspective view of an alternate embodiment of the two-piece Child Resistant Double Seam Container Lid 10K illustrating a round lid portion top piece 180 having drinking, dispensing and venting holes 184 and 186 therein. As shown here in FIG. 53 and FIG. 54, there is a larger hole 184 for dispensing liquids and a smaller hole 186 for venting the container while dispensing liquids.

FIG. 54 depicts a bottom perspective view of the alternate embodiment of the two-piece Child Resistant Double Seam Container Lid 10K shown in FIG. 53. In addition to the dispensing hole 184 and the venting hole 186, there is a rubber gasket or O-ring 190 extending around the circumference of the upper inner area of lid portion 180 making the lid liquid tight when in place on adapter ring 150, as disclosed in FIG. 47 through FIG. 52. Detail of the location of this rubber gasket or O-ring 190 can be seen in FIG. 55 below. Additionally, a plurality of lid locking tabs 188 are located on the edge of lid portion 180 which mate with the locking ring lid locking tab accepting openings 160 (see FIG. 51).

FIG. 55 depicts a partial cross-sectional view of the alternate embodiment of the two-piece Child Resistant Double Seam Container Lid 10K illustrating a round lid portion top piece 180 having drinking, dispensing and venting holes 184 and 186 therein, as shown in FIG. 54. The rubber gasket or O-ring 190 is located in the upper inner surface of the lid portion 180.

FIG. 56 depicts a top perspective view of an alternate embodiment of a one-piece Child Resistant Double Seam Container Lid 10L illustrating a lid portion 200 having incorporated integral finger grips 202 and 204 and container retaining guides 206 and 208 for facilitating stacking of containers so equipped.

FIG. 57 depicts a cross-sectional view of the alternate embodiment of the one-piece Child Resistant Double Seam Container Lid 10L shown in FIG. 56 illustrating the position of an O-ring 210 within the lid portion 200 enabling a liquid tight one-piece child resistant lid with finger grips and container retaining guides.

Figure 58:
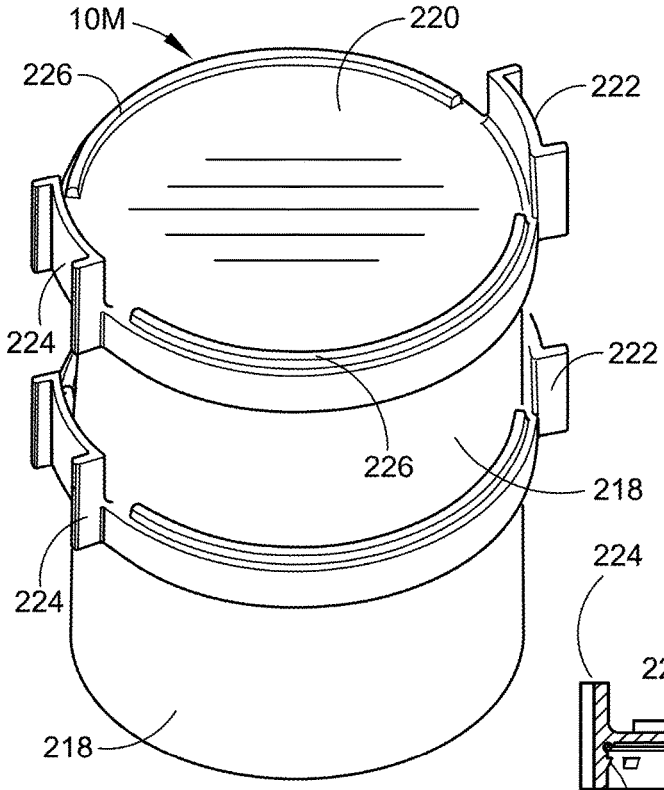
FIG. 58 depicts a top perspective view of an alternate embodiment of the Child Resistant Double Seam Container Lid illustrating two stacked containers having a one-piece child resistant lid with integral extended finger grips and incorporating larger container retaining guides located around the circumference of the one-piece lid.

FIG. 58 depicts a top perspective view of another alternate embodiment of the one-piece Child Resistant Double Seam Container Lid 10M illustrating two stacked containers 218 having a one-piece child resistant lid portion 220 with integral extended finger grips 222 and 224 and incorporating larger container retaining guides 226 located partially around the circumference of the one-piece lid portion 220. The larger retaining guides 226 secure the stacked containers 218 from sliding when stacked.

Figure 59:
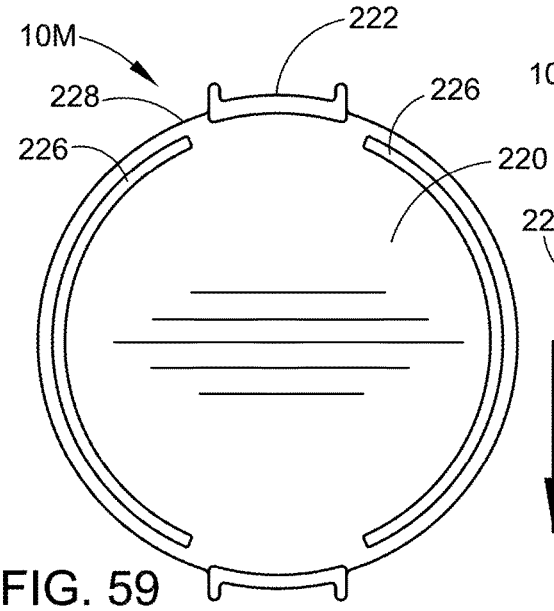
FIG. 59 depicts a top plan view of the alternate embodiment of the Child Resistant Double Seam Container Lid shown in FIG. 58.

FIG. 59 depicts a top plan view of the alternate embodiment of the one-piece Child Resistant Double Seam Container Lid 10M as shown in FIG. 58, further illustrating the finger grips 222 and the retaining guides 226.

Figure 60:
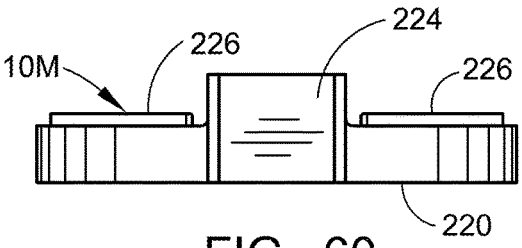
FIG. 60 depicts a front elevational view of the alternate embodiment of the Child Resistant Double Seam Container Lid shown in FIG. 59.

FIG. 60 depicts a front elevational view of the alternate embodiment of the one-piece Child Resistant Double Seam Container Lid 10M shown in FIG. 59, further illustrating the finger grips 224 and the retaining guides 226.

Figure 61:
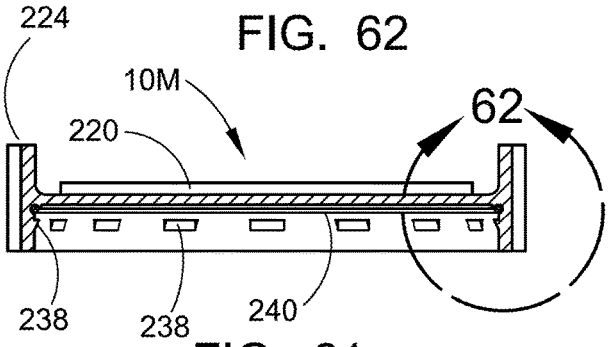
FIG. 61 depicts a cross-sectional view of the alternate embodiment of the Child Resistant Double Seam Container Lid shown in FIG. 63.
Figure 63:
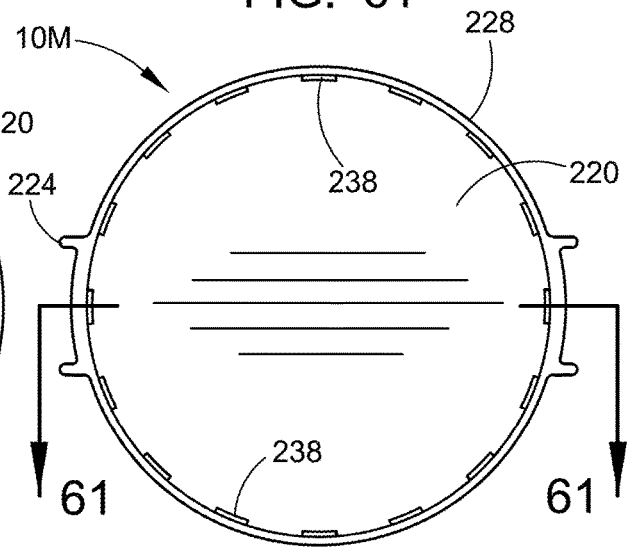
FIG. 63 depicts a bottom plan view of the alternate embodiment of the Child Resistant Double Seam Container Lid showing the one-piece child resistant lid with extended finger grips and larger container retaining guides shown in FIG. 59.

FIG. 61 depicts a cross-sectional view of the alternate embodiment of the one-piece Child Resistant Double Seam Container Lid 10M shown in FIG. 63. This view shows the bottom surface 240 of the lid portion 220, and the plurality of retaining teeth 238 located on the inner surface of lid portion 220. Also seen is a rubber gasket or O-ring 232 on the upper inner surface of the lid portion 220.

Figure 62:
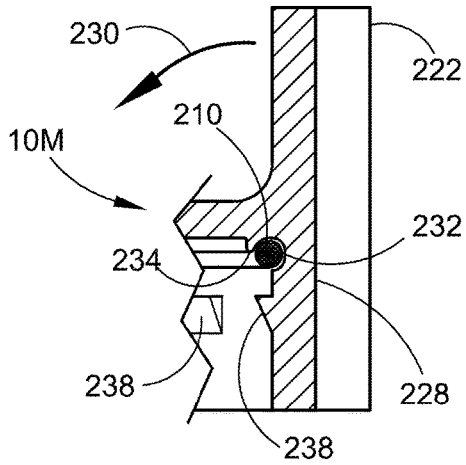
FIG. 62 depicts an enlarged cross-sectional partial view of a portion of the alternate embodiment of the Child Resistant Double Seam Container Lid one-piece lid with extended finger grips and larger container retaining guides shown in FIG. 61 illustrating the location of the O-ring.

FIG. 62 depicts an enlarged cross-sectional partial view of a portion of the alternate embodiment of the one-piece Child Resistant Double Seam Container Lid 10M one-piece lid portion 220 with extended finger grip 222 and larger container retaining guides (not shown here) as shown in FIG. 61 illustrating the location of the rubber gasket or O-ring 232 and the retaining teeth 238. The direction arrow 230 indicates the movement of the finger grip 222 when opening the container and removing the lid.

FIG. 63 depicts a bottom plan view of the alternate embodiment of the one-piece Child Resistant Double Seam Container Lid 10M showing the one-piece child resistant lid portion 220 with extended finger grips 224 as shown in FIG. 59. This view also shows the location of a plurality of retaining teeth 238 along the entire circumference of the lid portion 220 inner surface.

Figure 64:
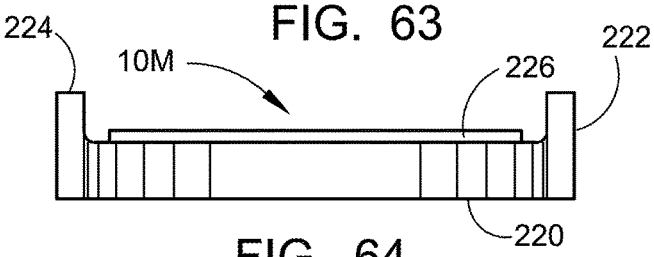
FIG. 64 depicts a side elevational view of the alternate embodiment of the Child Resistant Double Seam Container Lid illustrating the one-piece child resistant lid with extended finger grips and larger container retaining guides shown in FIG. 60.

FIG. 64 depicts a side elevational view of the alternate embodiment of the one-piece Child Resistant Double Seam Container Lid 10M illustrating the one-piece child resistant lid portion 220 with extended finger grips 222 and 224 and one of the two larger container retaining guides 226 as shown in FIG. 60.

Figure 65:
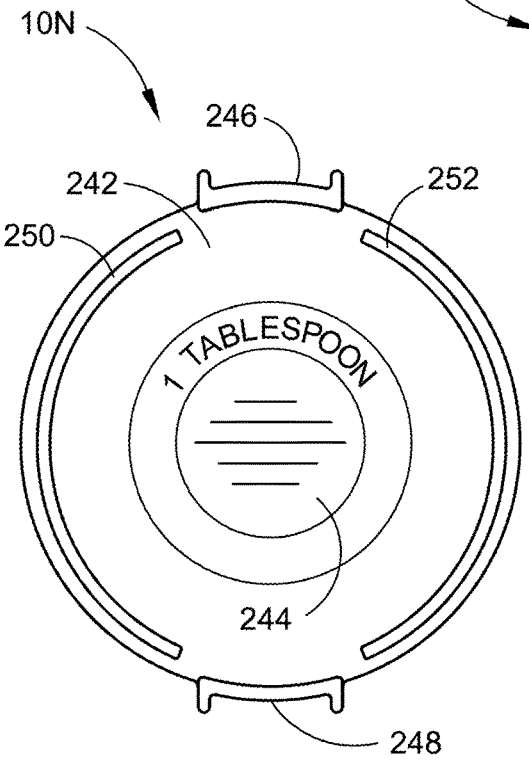
FIG. 65 depicts a top plan view of an alternate embodiment of the Child Resistant Double Seam Container Lid illustrating a one-piece child resistant lid with finger grips and an integrated 1 Tablespoon Measuring Cup located on the lid top surface.

FIG. 65 depicts a top plan view of an alternate embodiment of a one-piece Child Resistant Double Seam Container Lid 10N illustrating a one-piece child resistant lid portion 242 with finger grips 246 and 248, two semi-circular container stacking retaining guides 250 and 252 and an integrated 1 Tablespoon Measuring Cup 244 located on the upper surface of lid portion 242.

Figure 66:
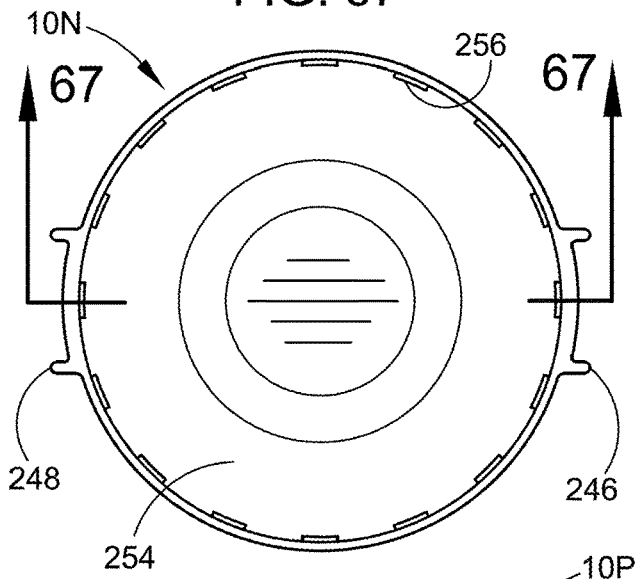
FIG. 66 depicts a bottom plan view of the alternate embodiment of the Child Resistant Double Seam Container Lid shown in FIG. 65 illustrating a one-piece child resistant lid with finger grips and an integrated 1 Tablespoon Measuring Cup located on the lid top surface.

FIG. 66 depicts a bottom plan view of the alternate embodiment of the one-piece Child Resistant Double Seam Container Lid 10N shown in FIG. 65 illustrating a one-piece child resistant lid 242 with finger grips 246 and 248 and an integrated 1 Tablespoon Measuring Cup located on the lid top surface, also showing a plurality of lid retaining teeth 256 located around the entire circumference of the lid inner surface 254.

Figure 67:
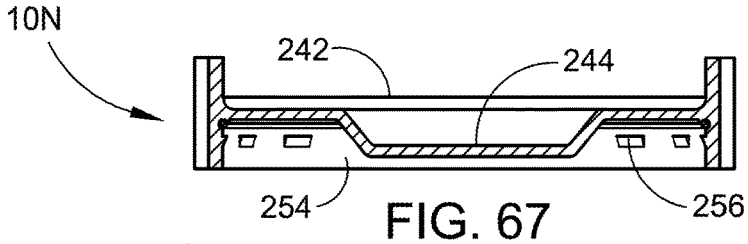
FIG. 67 depicts a cross-sectional view of the alternate embodiment of the Child Resistant Double Seam Container Lid shown in FIG. 66 illustrating a one-piece child resistant lid with finger grips and an integrated 1 Tablespoon Measuring Cup located on the lid top surface.

FIG. 67 depicts a cross-sectional view of the alternate embodiment of the one-piece Child Resistant Double Seam Container Lid 10N shown in FIG. 66 illustrating a one-piece child resistant lid 242 with finger grips and an integrated 1 Tablespoon Measuring Cup 244 integrally molded in to the lid top surface. Also seen are several of the plurality of retaining teeth 256 located around the circumference of the inner surface 254 of the lid portion 242.

Figure 68:
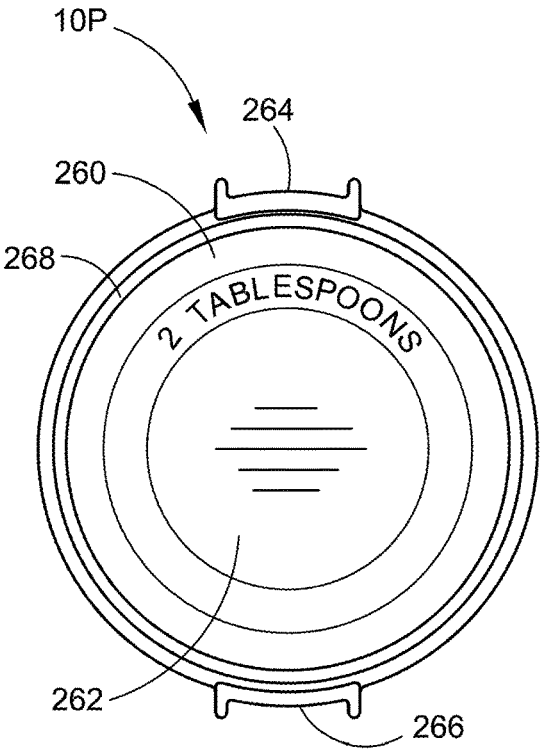
FIG. 68 depicts a top plan view of an alternate embodiment of the Child Resistant Double Seam Container Lid illustrating a one-piece child resistant lid with finger grips and an integrated 2 Tablespoon Measuring Cup located on the lid top surface.

FIG. 68 depicts a top plan view of an alternate embodiment of a one-piece Child Resistant Double Seam Container Lid 10P illustrating a one-piece child resistant lid portion 260 with finger grips 264 and 266, one circular container stacking retaining guide 268 and an integrated 2 Tablespoon Measuring Cup 262 located on the upper surface of lid portion 260.

Figure 69:
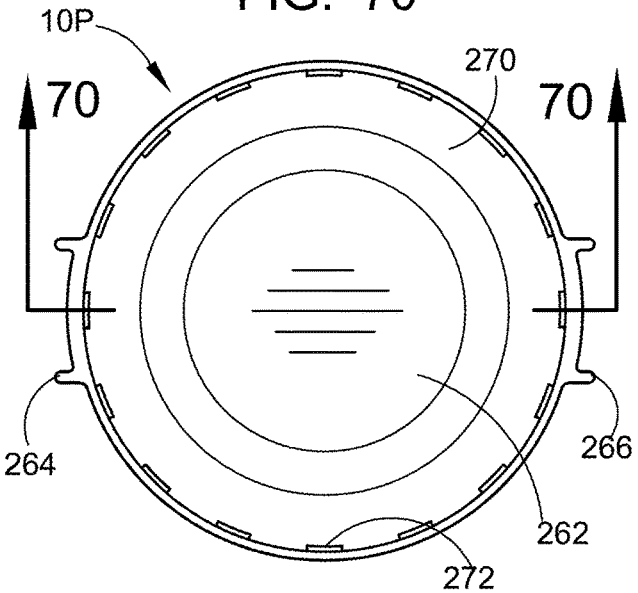
FIG. 69 depicts a bottom plan view of the alternate embodiment of the Child Resistant Double Seam Container Lid shown in FIG. 68 illustrating a one-piece child resistant lid with finger grips and an integrated 2 Tablespoon Measuring Cup located on the lid top surface.

FIG. 69 depicts a bottom plan view of the alternate embodiment of the one-piece Child Resistant Double Seam Container Lid 10P shown in FIG. 68 illustrating a one-piece child resistant lid 260 with finger grips 264 and 266 and container stacking retaining guide 268 along with an integrated 2 Tablespoon Measuring Cup located on the lid top surface, also showing a plurality of lid retaining teeth 272 located around the entire circumference of the lid inner surface 270.

Figure 70:
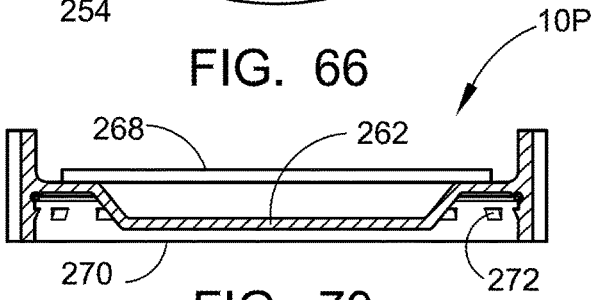
FIG. 70 depicts a bottom plan view of the one-piece Child Resistant Double Seam Container Lid with finger grips and an integrated 2 Tablespoon Measuring Cup shown in FIG. 69.

FIG. 70 depicts a cross-sectional view of the alternate embodiment of the one-piece Child Resistant Double Seam Container Lid 10P shown in FIG. 69 illustrating a one-piece child resistant lid 260 with finger grips and an integrated 2 Tablespoon Measuring Cup 262 integrally molded in to the lid top surface. Also seen in this view is several of the plurality of retaining teeth 272 located around the circumference of the inner surface 270 of the lid portion 260.

Figure 71:
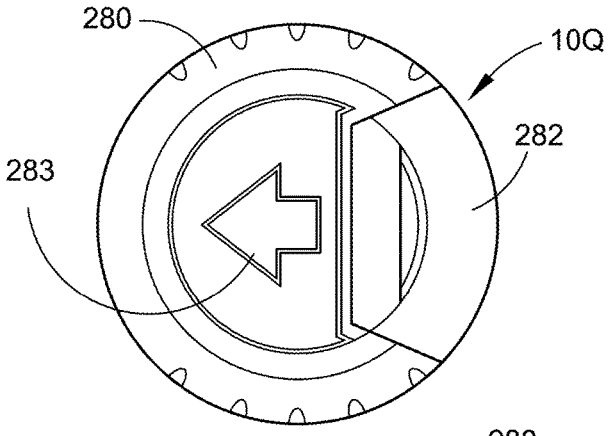
FIG. 71 depicts a top plan view of an alternate embodiment of a Child Resistant Double Seam Container Lid illustrating a two-piece child resistant lid with an integrated push out leverage tab.

FIG. 71 depicts a top plan view of an alternate embodiment of a two-piece Child Resistant Double Seam Container Lid 10Q illustrating the top piece of a two-piece child resistant lid portion 280 with an integrated push out leverage tab 282 located within the lid portion 280. The lid portion 280 has a direction arrow 283 molded in to the top surface to indicate which direction a user should push the push out leverage tab 282.

Figure 72:
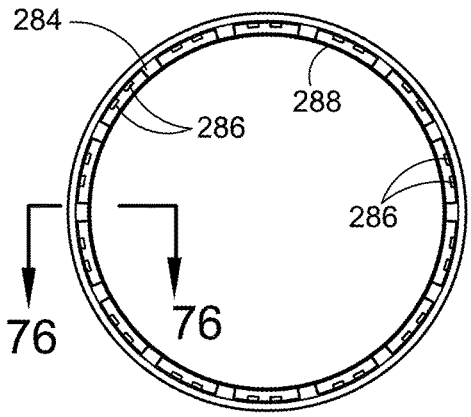
FIG. 72 depicts a bottom plan view of the alternate embodiment of the Child Resistant Double Seam Container Lid shown in FIG. 71 illustrating detail of a two-piece child resistant lid with an integrated push out leverage tab adapter ring piece.

FIG. 72 depicts a bottom plan view of the alternate embodiment of the two-piece Child Resistant Double Seam Container Lid 10Q illustrating detail of the adapter ring can locking member 284 of the two-piece child resistant lid with an integrated push out leverage tab 10Q. The adapter ring piece 284 includes a plurality of retaining teeth 286 along the circumference of the inner wall 288 of the adapter ring piece 284.

Figure 73:
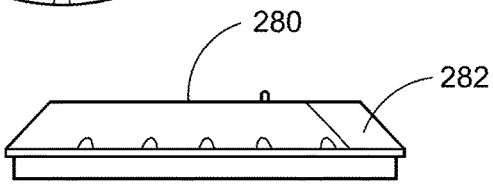
FIG. 73 depicts a side elevational view of the alternate embodiment of the Child Resistant Double Seam Container Lid shown in FIG. 71 having an integrated push out leverage tab on the lid portion piece of the two-piece child resistant lid with a push out leverage tab.

FIG. 73 depicts a side elevational view of the alternate embodiment of the two-piece Child Resistant Double Seam Container Lid 10Q lid portion 280 as shown in FIG. 71 having an integrated push out leverage tab 282 on the lid portion piece of the two-piece child resistant lid portion 280 with a push out leverage tab.

Figure 74:
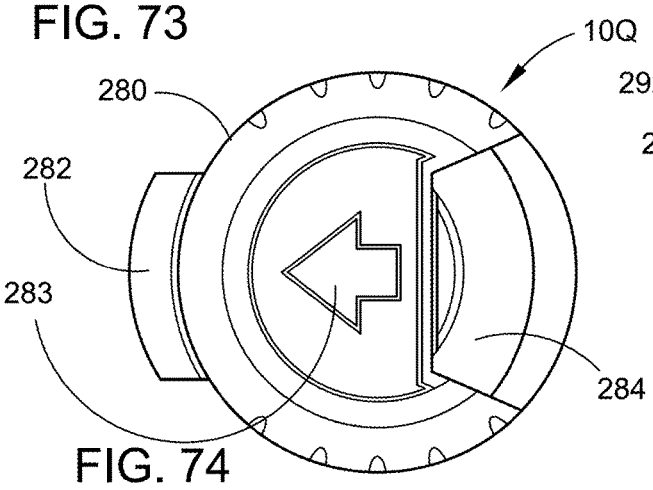
FIG. 74 depicts a top plan view of an alternate embodiment of the Child Resistant Double Seam Container Lid illustrating a two-piece child resistant lid with an integrated push out leverage tab, showing the push out leverage tab pushed out and extended for increased leverage during the removal of the lid portion.

FIG. 74 depicts a top plan view of the alternate embodiment of the two-piece Child Resistant Double Seam Container Lid 10Q illustrating a two-piece child resistant lid portion 280 with an integrated push out leverage tab 282, showing the push out leverage tab 282 pushed out in the direction of direction arrow 283 and extended for increased leverage during the removal of the lid portion 280.

Figure 75:
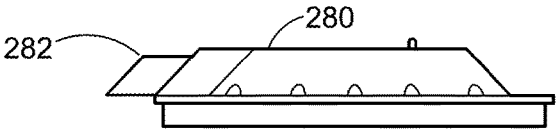
FIG. 75 depicts a side elevational view of the alternate embodiment of the Child Resistant Double Seam Container Lid shown in FIG. 74 illustrating a two-piece child resistant lid with an integrated push out leverage tab, showing the push out leverage tab pushed out and extended for increased leverage during the removal of the lid portion.

FIG. 75 depicts a side elevational view of the alternate embodiment of the two-piece Child Resistant Double Seam Container Lid 10Q shown in FIG. 74 illustrating a two-piece child resistant lid portion 280 with an integrated push out leverage tab 282, showing the push out leverage tab 282 pushed out in the direction of direction arrow 283 and extended for increased leverage during the removal of the lid portion 280.

Figure 76:
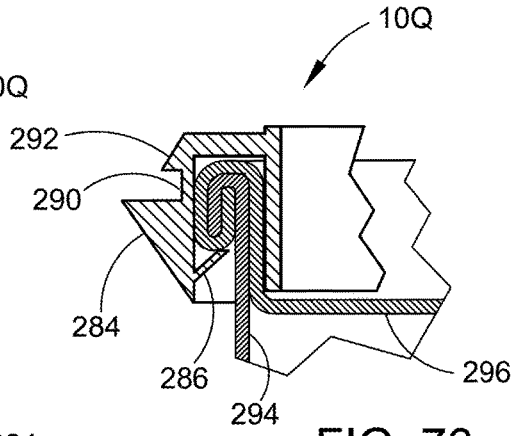
FIG. 76 depicts an enlarged partial cross-sectional view of the alternate embodiment of the Child Resistant Double Seam Container Lid shown in FIG. 74 illustrating detail of the adapter ring piece of the two-piece child resistant lid with a push out leverage tab shown in FIG. 72.

FIG. 76 depicts an enlarged partial cross-sectional view of the alternate embodiment of the two-piece Child Resistant Double Seam Container Lid 10Q as shown in FIG. 72 illustrating detail of the adapter ring piece 284 and showing the location of retaining teeth 286, a locking trough 290 and a locking nib 292. This view also shows the way the adapter ring 284 snaps on to the double seam of a container, which double seam is made from roll folding the container wall 294 and the container lid 296.

Figure 77:
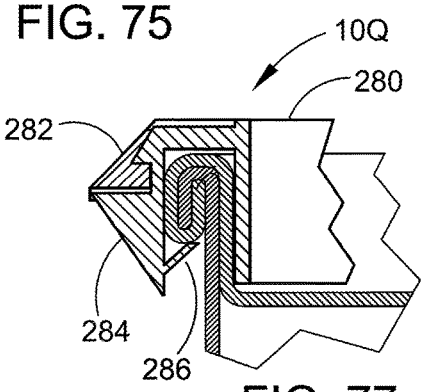
FIG. 77 depicts a cross-sectional view of the alternate embodiment of the Child Resistant Double Seam Container Lid shown in FIG. 74 illustrating the assembled adapter ring piece and lid portion piece of the two-piece child resistant lid with a push out leverage tab, showing the push out leverage tab pushed out and extended for increased leverage in removing the lid portion shown in FIG. 74 and FIG. 75.

FIG. 77 depicts a cross-sectional view of the alternate embodiment of the two-piece Child Resistant Double Seam Container Lid 10Q shown in FIG. 74 illustrating the assembled adapter ring piece 284 and lid portion piece 280 of the two-piece child resistant lid with a push out leverage tab 282, showing the push out leverage tab 282 pushed out and extended for increased leverage in removing the lid portion 280 as shown extended out in the top plan view of FIG. 74 and the side elevation view of FIG. 75.

Figure 78:
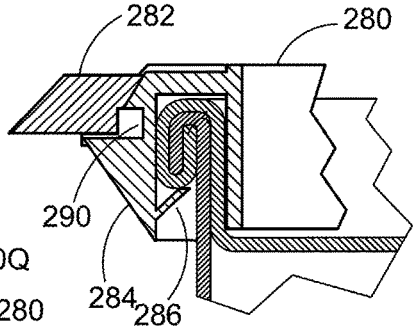
FIG. 78 depicts a cross-sectional view of the alternate embodiment of the Child Resistant Double Seam Container Lid shown in FIG. 74 illustrating the assembled adapter ring piece and lid portion piece of the two-piece child resistant lid with a push out leverage tab, showing the push out leverage tab in place as shown in FIG. 71 and FIG. 73.

FIG. 78 depicts a cross-sectional view of the alternate embodiment of the two-piece Child Resistant Double Seam Container Lid 10Q shown in FIG. 74 illustrating the assembled adapter ring piece 284 and lid portion piece 280 of the two-piece child resistant lid with a push out leverage tab 282, showing the push out leverage tab 282 in place, tucked in and not extended out for leverage as shown in top plan view FIG. 71 and side elevation view FIG. 73.

Figure 79:
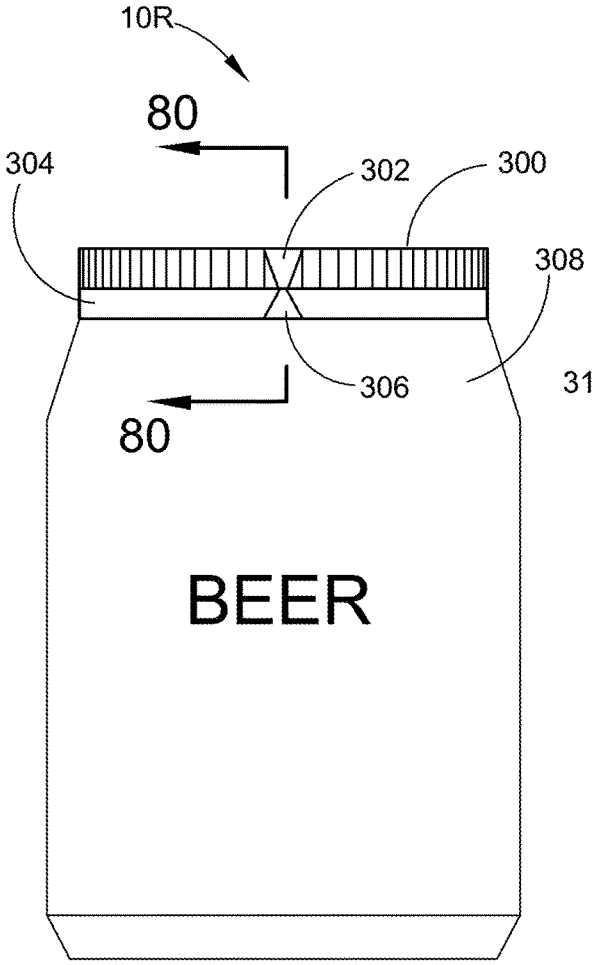
FIG. 79 depicts a side elevational view of an alternate embodiment of the Child Resistant Double Seam Container Lid illustrating a two-piece child resistant lid affixed to a beer can beverage container showing the rotational alignment indicators in alignment together allowing the removal of the lid portion piece.

FIG. 79 depicts a side elevational view of an alternate embodiment of a two-piece Child Resistant Double Seam Container Lid 10R for a beverage container, illustrating a two-piece child resistant lid portion 300 and an adapter ring piece 304 affixed to a beer can beverage container 308 showing the rotational alignment indicators 302 and 306 in alignment together allowing the removal of the lid portion piece 300.

Figure 80:
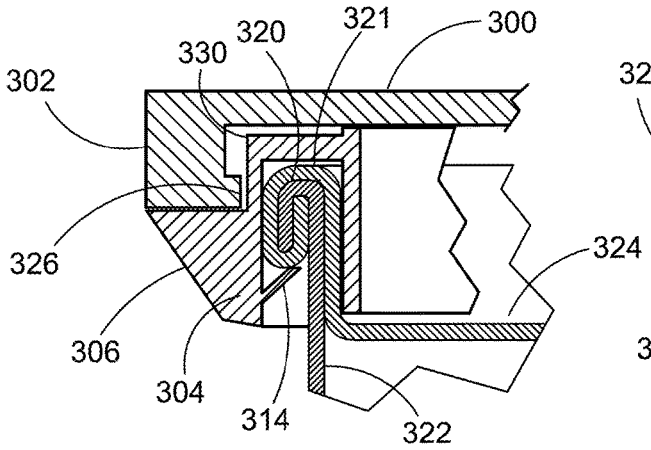
FIG. 80 depicts an enlarged partial cross-sectional view of the alternate embodiment of the Child Resistant Double Seam Container Lid as shown in FIG. 79 illustrating a two-piece child resistant lid affixed to a beer can beverage container showing the rotational alignment indicators in alignment together.

FIG. 80 depicts an enlarged partial cross-sectional view of the alternate embodiment of the Child Resistant Double Seam Container Lid 10R as shown in FIG. 79 illustrating a two-piece child resistant lid portion 300 and an adapter ring piece 304 affixed to a beer can beverage container 308 showing the rotational alignment indicators 302 and 306 in alignment together allowing the removal of the lid portion piece 300. This view also shows the adapter ring 304 snapped on to the double seam 320 made up of the container wall 322 and container lid 324. The adapter ring 304 is held securely in place within adapter ring cavity 321 by retaining teeth 314. Since rotational alignment indicators 302 and 306 are in alignment here, there is shown a small locking nib 330 which allows removal of the lid portion 300 by easily and readily lifting lid portion retaining tab 326 over the small locking nib 330.

Figure 81:
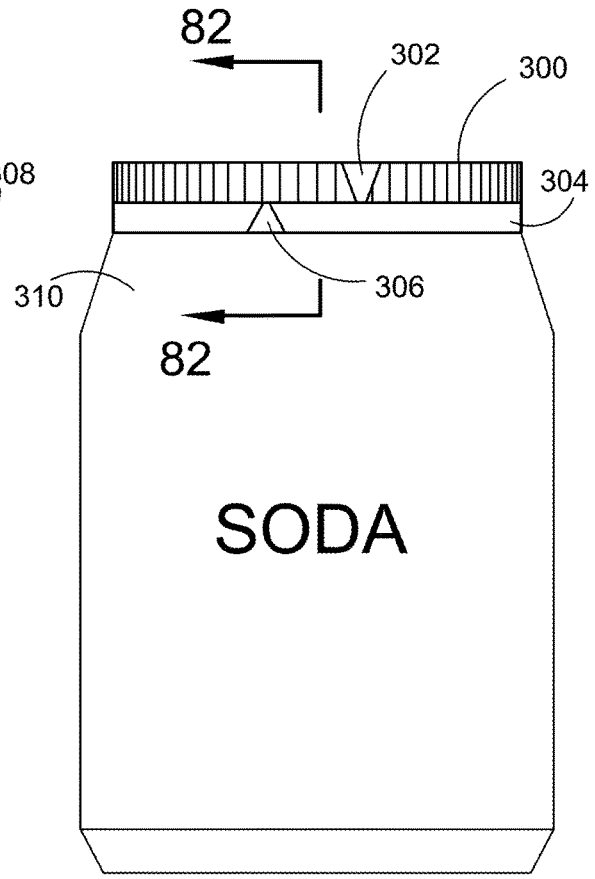
FIG. 81 depicts a side elevational view of an alternate embodiment of the Child Resistant Double Seam Container Lid illustrating a two-piece child resistant lid affixed to a soda can beverage container showing the rotational alignment indicators out of alignment and apart preventing the removal of the lid.

FIG. 81 depicts a side elevational view of the alternate embodiment of the two-piece Child Resistant Double Seam Container Lid 10R illustrating a two-piece child resistant lid portion 300 and adapter ring piece 304 affixed to a soda can beverage container 310 showing the rotational alignment indicators 302 and 306 out of alignment and rotated apart preventing the removal of the lid portion 300 off of the adapter ring piece 304.

Figure 82:
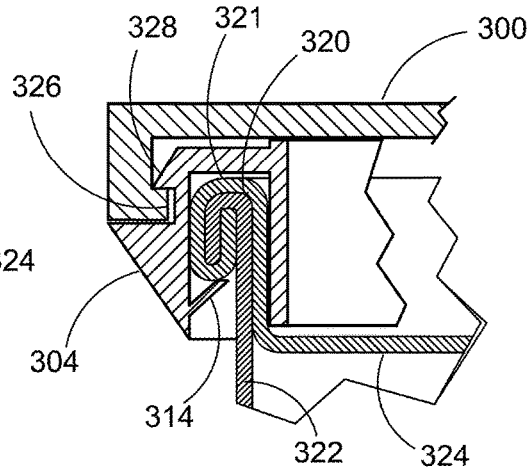
FIG. 82 depicts an enlarged partial cross-sectional view of the alternate embodiment of the Child Resistant Double Seam Container Lid as shown in FIG. 81 illustrating a two-piece child resistant lid affixed to a soda can beverage container showing the rotational alignment indicators out of alignment and apart preventing the removal of the lid.

FIG. 82 depicts an enlarged partial cross-sectional view of the alternate embodiment of the two-piece Child Resistant Double Seam Container Lid 10R as shown in FIG. 81 illustrating a two-piece child resistant lid portion 300 and an adapter ring piece 304 affixed to a soda can beverage container 308 showing the rotational alignment indicators 302 and 306 out of alignment apart preventing the easy removal of the lid portion piece 300. This view also shows the adapter ring 304 snapped on to the double seam 320 made up of the container wall 322 and container lid 324. The adapter ring 304 is held securely in place within adapter ring cavity 321 by retaining teeth 314. Since rotational alignment indicators 302 and 306 are out of alignment here, there is shown a large locking nib 338 which prevents removal of the lid portion 300 by making it difficult to lift lid portion retaining tab 326 over the large locking nib 328.

Figure 83:
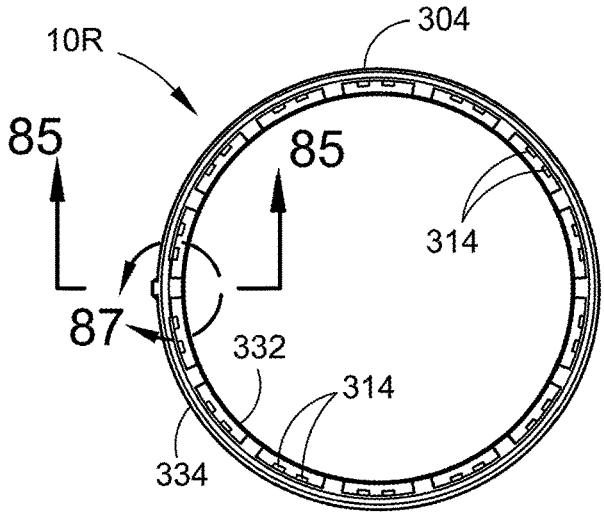
FIG. 83 depicts a top plan view of the round adapter ring piece of the two-piece Child Resistant Double Seam Container Lid as shown in FIG. 79 illustrating the retaining teeth which secure the round adapter ring piece to the beverage can.

FIG. 83 depicts a top plan view of the round adapter ring locking piece 304 of the two-piece Child Resistant Double Seam Container Lid 10R for beverage containers as shown in FIG. 79, illustrating the retaining teeth 314 which secure the round adapter ring locking piece 304 to the beverage can double seam top rim. The adapter ring locking piece 304 has an inner wall 332 and an outer wall 334, with the retaining teeth 314 located around the entire circumference of the inner wall 332.

Figure 84:
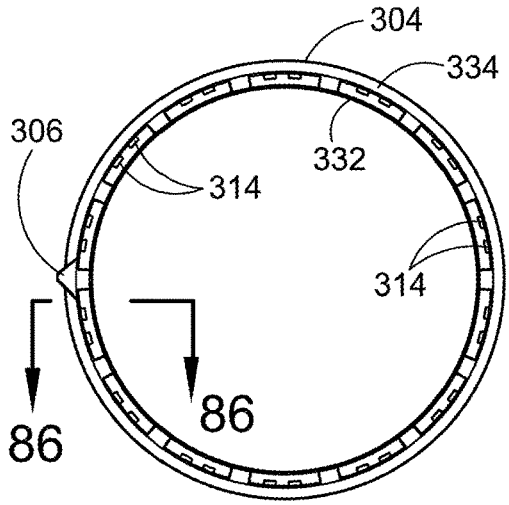
FIG. 84 depicts a bottom plan view of the round adapter ring piece of the two-piece Child Resistant Double Seam Container Lid as shown in FIG. 79 illustrating the retaining teeth which secure the round adapter ring piece to the beverage can.

FIG. 84 depicts a bottom plan view of the round adapter ring locking piece 304 of the two-piece Child Resistant Double Seam Container Lid 10R as shown in FIG. 79 illustrating the retaining teeth 314 which secure the round adapter ring locking piece 304 to the beverage can double seam top rim. The adapter ring locking piece 304 has an inner wall 332 and an outer wall 334, with the retaining teeth 314 located around the entire circumference of the inner wall 332.

Figure 85:
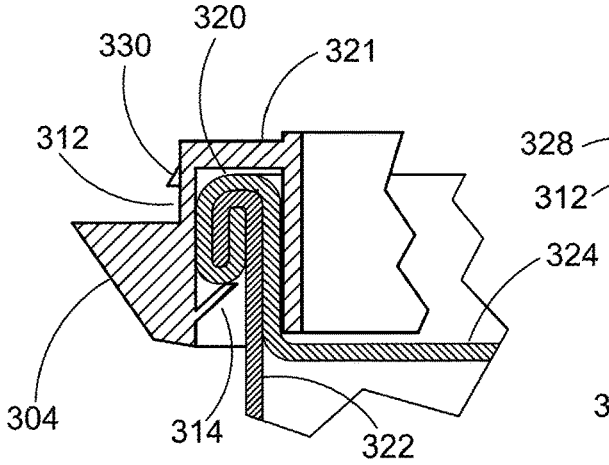
FIG. 85 depicts an enlarged partial cross-sectional view of the adapter ring piece of the two-piece Child Resistant Double Seam Container Lid as shown in FIG. 83 illustrating the small retaining nib thereon.

FIG. 85 depicts an enlarged partial cross-sectional view of the alternate embodiment of the Child Resistant Double Seam Container Lid 10R as shown in FIG. 83 illustrating an adapter ring piece 304 affixed to a beverage container double seam top rim 320. This view also shows the adapter ring 304 snapped on to the double seam 320 made up of the container wall 322 and container lid 324. The adapter ring 304 is held securely in place within adapter ring cavity 321 by retaining teeth 314. There is also shown a small locking nib 330.

Figure 86:
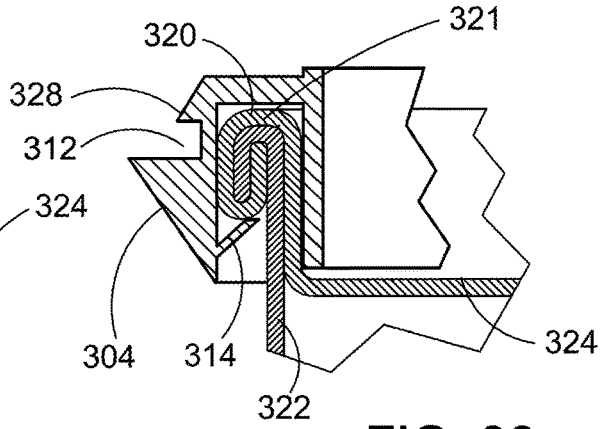
FIG. 86 depicts an enlarged partial cross-sectional view of the adapter ring piece of the two-piece Child Resistant Double Seam Container Lid as shown in FIG. 84 illustrating the large locking nib thereon.

FIG. 86 depicts an enlarged partial cross-sectional view of the alternate embodiment of the two-piece Child Resistant Double Seam Container Lid 10R as shown in FIG. 84 illustrating a two-piece child resistant lid portion 300 and an adapter ring piece 304 affixed to a soda can beverage container. This view also shows the adapter ring 304 snapped on to the double seam 320 made up of the container wall 322 and container lid 324. The adapter ring 304 is held securely in place within adapter ring cavity 321 by retaining teeth 314. There is also shown a large locking nib 338 which prevents removal of the lid portion 300 by making it difficult to lift lid portion retaining tab 326 over the large locking nib 328.

Figure 87:
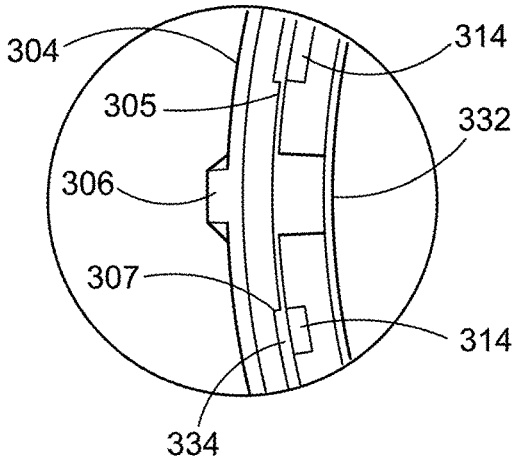
FIG. 87 depicts an enlarged detailed partial view of the top plan view of the adapter ring piece of the two-piece Child Resistant Double Seam Container Lid as shown in FIG. 83 illustrating the rotational alignment indicator area.

FIG. 87 depicts an enlarged detailed partial view of the top plan view of the adapter ring piece 304 of the two-piece Child Resistant Double Seam Container Lid 10R as shown in FIG. 83 illustrating the rotational alignment indicator 306 area. This view also reveals the inner wall 332, the outer wall 334 and the retaining teeth 314, along with locking slots 305 and 307. The recessed area between locking slots 305 and 307 allow the retaining tab 326 (see FIG. 88) to be easily lifted out, and the lid portion removed.

Figure 88:
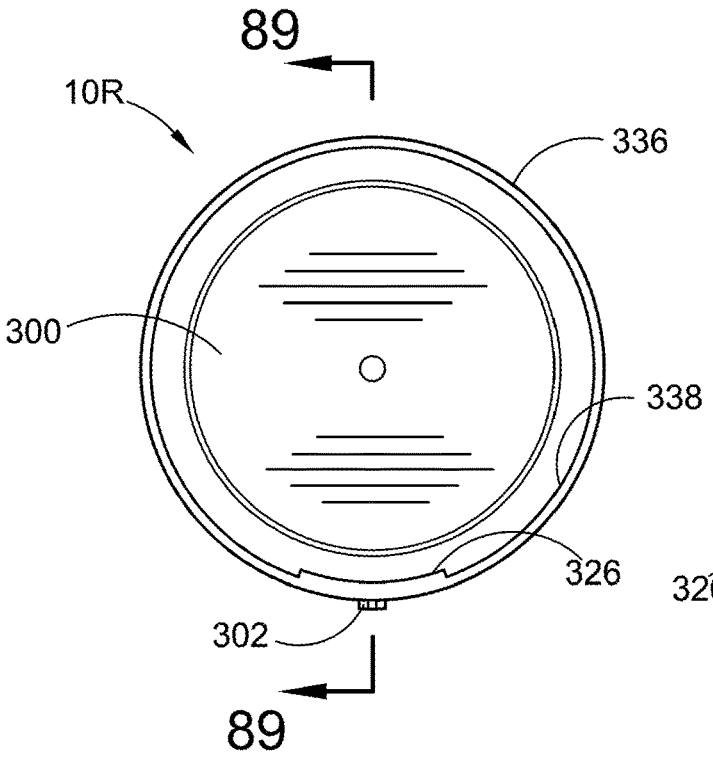
FIG. 88 depicts a bottom plan view of the lid portion of the Child Resistant Double Seam Container Lid as shown in FIG. 79 to FIG. 82 illustrating the retaining tab position relative to the rotational alignment indicators.

FIG. 88 depicts a bottom plan view of the lid portion 300 of the Child Resistant Double Seam Container Lid 10R as shown in FIG. 79 through FIG. 82 illustrating the retaining tab 326 position relative to the rotational alignment indicator 302. The lid portion 300 has an outer wall 336 and an inner wall 338, with the locking tab 326 positioned along the inner wall 338.

Figure 89:
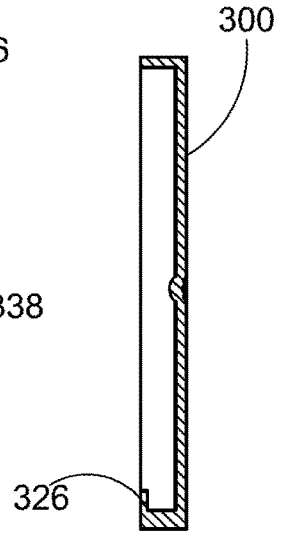
FIG. 89 depicts a cross-sectional view of the lid portion piece of the Child Resistant Double Seam Container Lid as shown in FIG. 88 illustrating the retaining tab located on the lid portion piece of the two-piece child resistant lid.

FIG. 89 depicts a cross-sectional view of the lid portion piece of the two-piece Child Resistant Double Seam Container Lid 10R as shown in FIG. 88 illustrating the position of the retaining tab 326 located on the lid portion piece 300.

Figure 90:
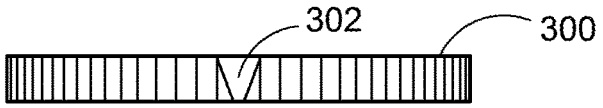
FIG. 90 depicts a side elevational view of the lid portion of the Child Resistant Double Seam Container Lid as shown in FIG. 88 and FIG. 89 illustrating the position of the rotational alignment indicator thereon.

FIG. 90 depicts a side elevational view of the lid portion 300 of the two-piece Child Resistant Double Seam Container Lid 10R as shown in FIG. 88 and FIG. 89 illustrating the position of the rotational alignment indicator 302 thereon. The rotational alignment indicator 302 is located in proximity to the retaining tab 326 located on the lid portion piece 300.

Figure 91:
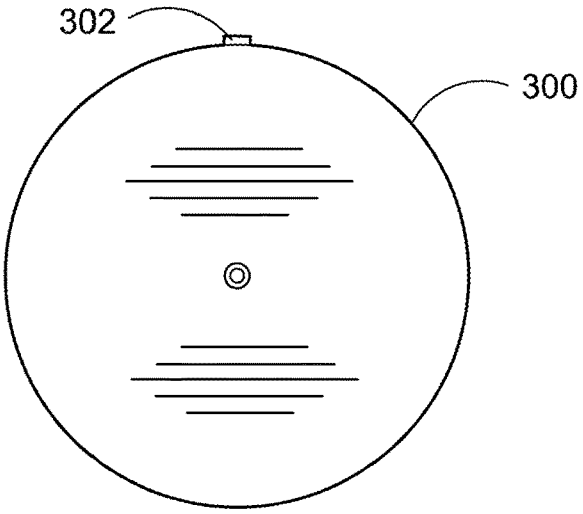
FIG. 91 depicts a top plan view of the lid portion of the Child Resistant Double Seam Container Lid as shown in FIG. 88 and FIG. 90 illustrating the position of the rotational alignment indicator thereon.

FIG. 91 depicts a top plan view of the lid portion 300 of the two-piece Child Resistant Double Seam Container Lid 10R as shown in FIG. 88 and FIG. 90 illustrating the position of the rotational alignment indicator 302 thereon.

The Child Resistant Double Seam Container Lid 10A, 10B, 10C, 10D, 10E, 10F, 10G, 10H, 10J, 10K, 10L, 10M, 10N, 10P, 10Q, and 10R shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing a Child Resistant Double Seam Container Lid 10A, 10B, 10C, 10D, 10E, 10F, 10G, 10H, 10J, 10K, 10L, 10M, 10N, 10P, 10Q, and 10R in accordance with the spirit of this disclosure, and such changes, alternations and modifications as would occur to those skilled in the art are considered to be within the scope of this design as broadly defined in the appended claims.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. For example, one portion of one of the embodiments described herein can be substituted for another portion in another embodiment described herein. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Further, the purpose of the foregoing abstract is to enable the U.S. Patent and Trademark Office, foreign patent offices worldwide and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

We claim:

1. A one-piece child resistant container lid comprising:

a lid portion including two integral finger grips; and two or more integral container stacking retaining guides, wherein the individual retaining guides are positioned opposite each other about a circumference of the lid portion, the individual retaining guides being separated from each other by gaps, and wherein individual finger grips are circumferentially aligned with individual gaps, wherein the lid portion is affixable to a double seam top seam of a double seam container to form an airtight seal between the lid portion and the double seam container, and wherein, when the two finger grips are pushed toward the center of the lid portion, the lid is readily removable from the double seam container.

2. The one-piece child resistant container lid of claim 1, wherein the lid portion further includes retaining teeth configured to releasably secure the lid portion to the double seam container.

3. The one-piece child resistant container lid of claim 1, wherein the lid portion further includes an O-ring configured to make the lid portion capable of being liquid tight.

4. The one-piece child resistant container lid of claim 1, wherein the two or more integral container stacking retaining guides enable stable stacking of two or more double seam containers.

5. The one-piece child resistant container lid of claim 1 wherein the individual finger grips are positioned opposite each other about a circumference of the lid portion.

6. The one-piece child resistant container lid of claim 1 wherein the individual retaining guides are positioned opposite each other about a circumference of the lid portion.

7. The one-piece child resistant container lid of claim 1 wherein: the individual retaining guides extend about a first portion of the circumference of the lid portion; and the individual finger grips extend about a second portion of the circumference of the lid portion, wherein the first portion is greater than the second portion.

8. The one-piece child resistant container lid of claim 1 wherein the lid portion further comprises retaining teeth extending about a circumference of the lid portion and positioned to releasably secure the lid portion to the double seam container.

9. The one-piece child resistant container lid of claim 1 wherein, when the lid portion is affixed to a double seam container, the individual finger grips are sized and positioned to extend beyond an upper surface of the lid portion.

10. The one-piece child resistant container lid of claim 9 wherein the lid has a thickness having a first dimension, and wherein the individual finger grips extend beyond the upper surface of the lid portion by a second dimension approximately twice the first dimension.

11. The one-piece child resistant container lid of claim 1 wherein the individual retaining guides are spaced apart from and out of contact with the individual finger grips.

* * * * *